US010486432B2

(12) United States Patent
Ishii

(10) Patent No.: US 10,486,432 B2
(45) Date of Patent: Nov. 26, 2019

(54) IMAGE PROCESSING APPARATUS, IMAGE PROCESSING METHOD, AND STORAGE MEDIUM

(71) Applicant: CANON KABUSHIKI KAISHA, Tokyo (JP)

(72) Inventor: Toshiyuki Ishii, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/987,644

(22) Filed: May 23, 2018

(65) Prior Publication Data

US 2018/0345680 A1 Dec. 6, 2018

(30) Foreign Application Priority Data

May 31, 2017 (JP) ..... 2017-107453

(51) Int. Cl.

| | |
|---|---|
| ***B41J 2/205*** | (2006.01) |
| ***B41J 3/407*** | (2006.01) |
| ***B41J 2/21*** | (2006.01) |
| ***B42D 25/00*** | (2014.01) |

(52) U.S. Cl.

CPC ..... *B41J 2/2056* (2013.01); *B41J 2/2054* (2013.01); *B41J 2/2132* (2013.01); *B41J 2/2135* (2013.01); *B41J 3/407* (2013.01); *B42D 25/00* (2014.10)

(58) Field of Classification Search

CPC ..... B41J 2/2056; B41J 2/2054; B41J 2/2135; B41J 2/2132; B41J 3/407; B42D 25/00

See application file for complete search history.

(56) References Cited

U.S. PATENT DOCUMENTS

2015/0254505 A1* 9/2015 Sohgawa ..... G06T 5/00 382/112

FOREIGN PATENT DOCUMENTS

JP 2017-052154 A 3/2017
JP 2017052154 A * 3/2017 ..... B41J 2/2054

* cited by examiner

*Primary Examiner* — Yaovi M Ameh
(74) *Attorney, Agent, or Firm* — Canon USA, Inc., IP Division

(57) ABSTRACT

An image processing apparatus that generates data for setting different colors for a projected portion and a recessed portion of an unevenness on a surface of a recording medium by recording a colored printing material on at least the projected portion of the unevenness includes a first acquisition unit configured to acquire recording amount data representing a recording amount of the colored printing material, and a halftoning unit configured to perform first halftoning on the recording amount data to arrange a larger number of dots of the colored printing material to be recorded on the projected portion of the unevenness at a center of the projected portion than at edges of the projected portion.

20 Claims, 15 Drawing Sheets m-TH MAIN SCANNING (m+1)TH MAIN SCANNING (m+2)TH MAIN SCANNING

FIG.9A

SECOND THRESHOLD MATRIX OF DOT DISPERSION TYPE

| | | | |
|---|---|---|---|
| 167 | 58 | 170 | 60 |
| 99 | 212 | 40 | 240 |
| 43 | 117 | 170 | 63 |
| 89 | 230 | 40 | 115 |
| 190 | 50 | 146 | 237 |
| 142 | 105 | 186 | 66 |
| 30 | 238 | 8 | 210 |
| 188 | 68 | 179 | 75 |

x y

| | | | | | | | | | | | | | | | | | | | |
|---|---|---|---|---|---|---|---|---|---|---|---|---|---|---|---|---|---|---|---|
| 0 | 0 | 0 | 0 | 1 | 1 | 1 | 1 | 1 | 1 | 1 | 1 | 0 | 0 | 0 | 0 | 1 | 1 | 1 | 1 |
| 0 | 0 | 0 | 0 | 1 | 1 | 1 | 1 | 1 | 1 | 1 | 1 | 0 | 0 | 0 | 0 | 1 | 1 | 1 | 1 |
| 0 | 0 | 0 | 0 | 1 | 1 | 1 | 1 | 1 | 1 | 1 | 1 | 0 | 0 | 0 | 0 | 1 | 1 | 1 | 1 |
| 0 | 0 | 0 | 0 | 1 | 1 | 1 | 1 | 1 | 1 | 1 | 1 | 0 | 0 | 0 | 0 | 1 | 1 | 1 | 1 |
| 0 | 0 | 0 | 0 | 1 | 1 | 1 | 1 | 1 | 1 | 1 | 1 | 0 | 0 | 0 | 0 | 1 | 1 | 1 | 1 |
| 0 | 0 | 0 | 0 | 1 | 1 | 1 | 1 | 1 | 1 | 1 | 1 | 0 | 0 | 0 | 0 | 1 | 1 | 1 | 1 |
| 0 | 0 | 0 | 0 | 1 | 1 | 1 | 1 | 1 | 1 | 1 | 1 | 0 | 0 | 0 | 0 | 1 | 1 | 1 | 1 |
| 0 | 0 | 0 | 0 | 1 | 1 | 1 | 1 | 1 | 1 | 1 | 1 | 0 | 0 | 0 | 0 | 1 | 1 | 1 | 1 |

FIRST THRESHOLD MATRIX OF DOT CONCENTRATION TYPE

| | | | | | | | |
|---|---|---|---|---|---|---|---|
| 255 | 170 | 85 | 1 | 1 | 85 | 170 | 255 |
| 255 | 170 | 85 | 1 | 1 | 85 | 170 | 255 |
| 255 | 170 | 85 | 1 | 1 | 85 | 170 | 255 |
| 255 | 170 | 85 | 1 | 1 | 85 | 170 | 255 |
| 255 | 170 | 85 | 1 | 1 | 85 | 170 | 255 |
| 255 | 170 | 85 | 1 | 1 | 85 | 170 | 255 |
| 255 | 170 | 85 | 1 | 1 | 85 | 170 | 255 |
| 255 | 170 | 85 | 1 | 1 | 85 | 170 | 255 |

FIG.9B

FIRST THRESHOLD MATRIX OF DOT CONCENTRATION TYPE

| | | | | | | | |
|---|---|---|---|---|---|---|---|
| 255 | 170 | 170 | 180 | 180 | 190 | 190 | 200 |
| 255 | 160 | 70 | 70 | 80 | 80 | 90 | 200 |
| 255 | 160 | 60 | 10 | 10 | 20 | 90 | 210 |
| 255 | 150 | 60 | 5 | 5 | 20 | 100 | 210 |
| 255 | 150 | 50 | 5 | 5 | 30 | 100 | 220 |
| 255 | 140 | 50 | 40 | 40 | 30 | 110 | 220 |
| 255 | 140 | 130 | 130 | 120 | 120 | 110 | 230 |
| 255 | 255 | 255 | 250 | 250 | 240 | 240 | 230 |

| | | | | | | | |
|---|---|---|---|---|---|---|---|
| 255 | 255 | 255 | 255 | 255 | 255 | 255 | 255 |
| 255 | 170 | 170 | 170 | 170 | 170 | 170 | 255 |
| 255 | 170 | 85 | 85 | 85 | 85 | 170 | 255 |
| 255 | 170 | 85 | 1 | 1 | 85 | 170 | 255 |
| 255 | 170 | 85 | 1 | 1 | 85 | 170 | 255 |
| 255 | 170 | 85 | 85 | 85 | 85 | 170 | 255 |
| 255 | 170 | 170 | 170 | 170 | 170 | 170 | 255 |
| 255 | 255 | 255 | 255 | 255 | 255 | 255 | 255 |

FIG.14

| C | M | Y | K | X | Y | Z |
|---|---|---|---|---|---|---|
| 0 | 0 | 0 | 0 | **** | **** | **** |
| 0 | 0 | 0 | 32 | **** | **** | **** |
| 0 | 0 | 0 | 64 | **** | **** | **** |
| . | . | . | . | **** | **** | **** |
| . | . | . | . | **** | **** | **** |
| . | . | . | . | . | . | . |
| 64 | 128 | 224 | 224 | . | . | . |
| 64 | 128 | 224 | 255 | . | . | . |
| 64 | 128 | 255 | 0 | . | . | . |
| . | . | . | . | . | . | . |
| . | . | . | . | . | . | . |
| . | . | . | . | . | . | . |
| 255 | 255 | 255 | 224 | . | . | . |
| 255 | 255 | 255 | 255 | **** | **** | **** |

IMAGE PROCESSING APPARATUS, IMAGE PROCESSING METHOD, AND STORAGE MEDIUM

BACKGROUND

Field of the Disclosure

The present disclosure generally relates to image processing and, more particularly, to an image processing apparatus, an image processing method, a storage medium, and an image processing technique for reproducing colors on a recording medium having an unevenness formed thereon.

Description of the Related Art

A printer having ultraviolet curable resin ink (hereinafter referred to as UV ink) mounted thereon has recently arrived at the market. The UV printer can cure UV ink by irradiating the UV ink with ultraviolet light. By repeatedly coating and curing the UV ink by using the UV printer, an unevenness can be formed on a surface of a print product. The unevenness formed on the surface of the print product affects reflection characteristics of the print product such as a reflection direction and a reflection strength of incident light. Accordingly, the reflection characteristics of the print product can be controlled not only by controlling colors like in the related art, but also by controlling the unevenness formed on the surface of the print product.

Japanese Patent Application Laid-Open No. 2017-052154 discusses a technique for controlling reflection characteristics of a print product by controlling an unevenness and colors. Japanese Patent Application Laid-Open No. 2017-052154 also discusses a technique in which a fine unevenness with a parallel line pattern is formed and recessed portions and projected portions of the unevenness are colored with respective different colors. In a print product formed by the technique discussed in Japanese Patent Application Laid-Open No. 2017-052154, the area ratio between the projected portions and the recessed portions as viewed from an observer varies depending on an observation angle. Accordingly, when the print product is observed, color appearances vary depending on the observation angle.

However, printing materials to be recorded on a recording medium tend to wet and spread over the recording medium after the application of the printing materials. Thus, the printing materials coated on the projected portions of the unevenness flow into the recessed portions. Therefore, there are areas for improvement in image processing technology in that colors to be reproduced by coating the projected portions and the recessed portions with printing materials of respective different colors cannot be reproduced with a high accuracy.

SUMMARY

The present disclosure is directed to providing an image processing technique for reproducing colors with a high accuracy on a recording medium having an unevenness formed on a surface thereof.

According to an one or more aspects of the present disclosure, an image processing apparatus that generates data for setting different colors for a projected portion and a recessed portion of an unevenness on a surface of a recording medium by recording a colored printing material on at least the projected portion of the unevenness includes a first acquisition unit configured to acquire recording amount data representing a recording amount of the colored printing material, and a halftoning unit configured to perform first halftoning on the recording amount data to arrange a larger number of dots of the colored printing material to be recorded on the projected portion of the unevenness at a center of the projected portion than at edges of the projected portion.

Further features of the present disclosure will become apparent from the following description of exemplary embodiments with reference to the attached drawings.

BRIEF DESCRIPTION OF THE DRAWINGS

FIGS. 9A and 9B are schematic diagrams each illustrating a threshold matrix.

FIG. 10 is a flowchart illustrating path decomposition processing.

FIG. 14 is a diagram illustrating an example of a color separation look-up table (LUT).

DESCRIPTION OF THE EMBODIMENTS

Exemplary embodiments of the present disclosure will be described below with reference to the drawings.

<Structure of Anisotropic Print Product>

Figure 1A:
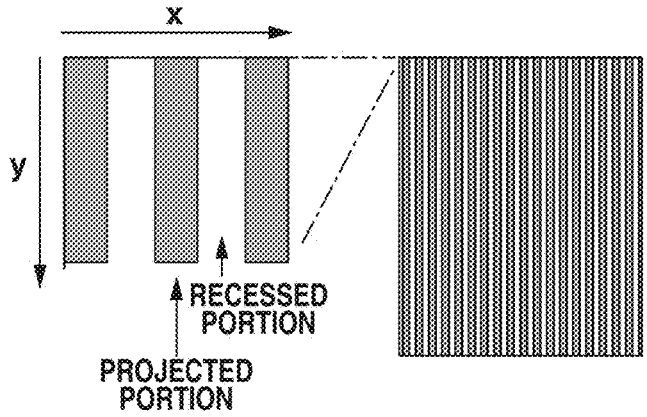
FIGS. 1A, 1B, and 10 are schematic diagrams each illustrating a structure of an anisotropic print product.
Figure 1B:
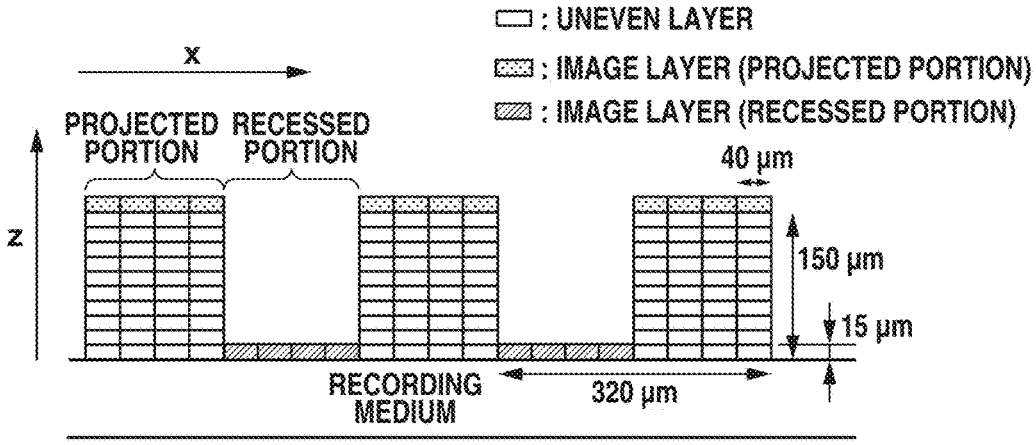
Figure 1C:
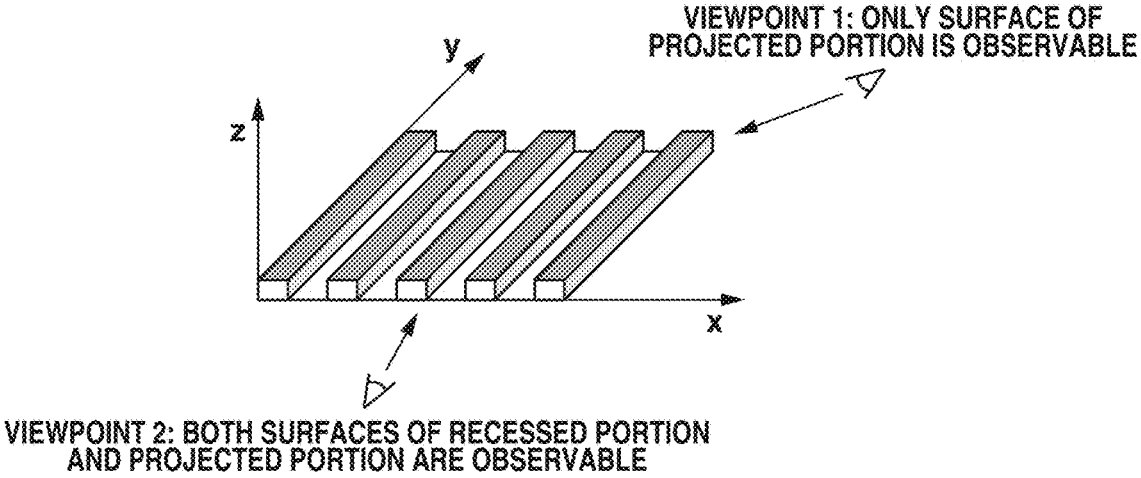

Prior to describing a first exemplary embodiment, a structure of an anisotropic print product will now be described with reference to schematic diagrams of FIGS. 1A, 1B, and 1C. FIG. 1A illustrates an uneven shape formed on an xy two-dimensional plane on a recording medium. Recessed portions and projected portions are repeatedly arranged in an x-axis direction, and a so-called vertical line pattern is formed as observed from a position facing a print surface. FIG. 1B illustrates a sectional structure of the uneven shape on an xz plane. In the present exemplary embodiment, it is assumed that the printer resolution is about 600 dpi and the width of one dot is 40 μm. In a structure in which projected portions are formed by repeatedly arranging four dots in the x-axis direction and recessed portions are formed by repeatedly arranging four dots in the x-axis direction, one cycle of the unevenness is 320 μm. In this example, the thickness (height) of one layer (one dot) 15 μm and the projected portions are formed by stacking 10 dots in a z-axis direction. Accordingly, the height of each projected portion 150 μm. Such an uneven layer having fine projected portions and recessed portions is not visually recognized from an observer and thus the structure looks like a flat print product such as paper or cloth. FIG. 1C is a schematic diagram illustrating that different colors are observed according to variation in observation angle in the print product formed according to the present exemplary embodiment. Colors are designated for the respective image layers formed on the surface of each projected portion and the surface of each recessed portion. Accordingly, when the print product is observed from a viewpoint 1, only the color of each projected portion is observed by occlusion, and when the print product is observed from a viewpoint 2, the mixed color of the colors of the surface of each projected portion and the surface of each recessed portion is observed. The structure of the print product looks like a flat surface. However, if the azimuth angle of the observation direction is changed, color appearances vary depending on the color recorded on each projected portion and the color recorded on each recessed portion.

In a case where a variation in colors to be observed according to a change in observation angle is expressed on a recording medium, respective different colors of colored printing materials are recorded on the surface of each projected portion and the surface of each recessed portion. In this case, the colored printing material recorded on the surface of each projected portion flows into the surface of each recessed portion, which leads to a deterioration in color reproduction accuracy. In the present exemplary embodiment, an example will be described in which the colored printing material recorded on the surface of each projected portion is prevented from flowing into the surface of each recessed portion by switching processing to be performed on each projected portion and processing to be performed on each recessed portion according to the uneven shape.

<Hardware Configuration of Image Processing Apparatus 1>

Figure 2A:
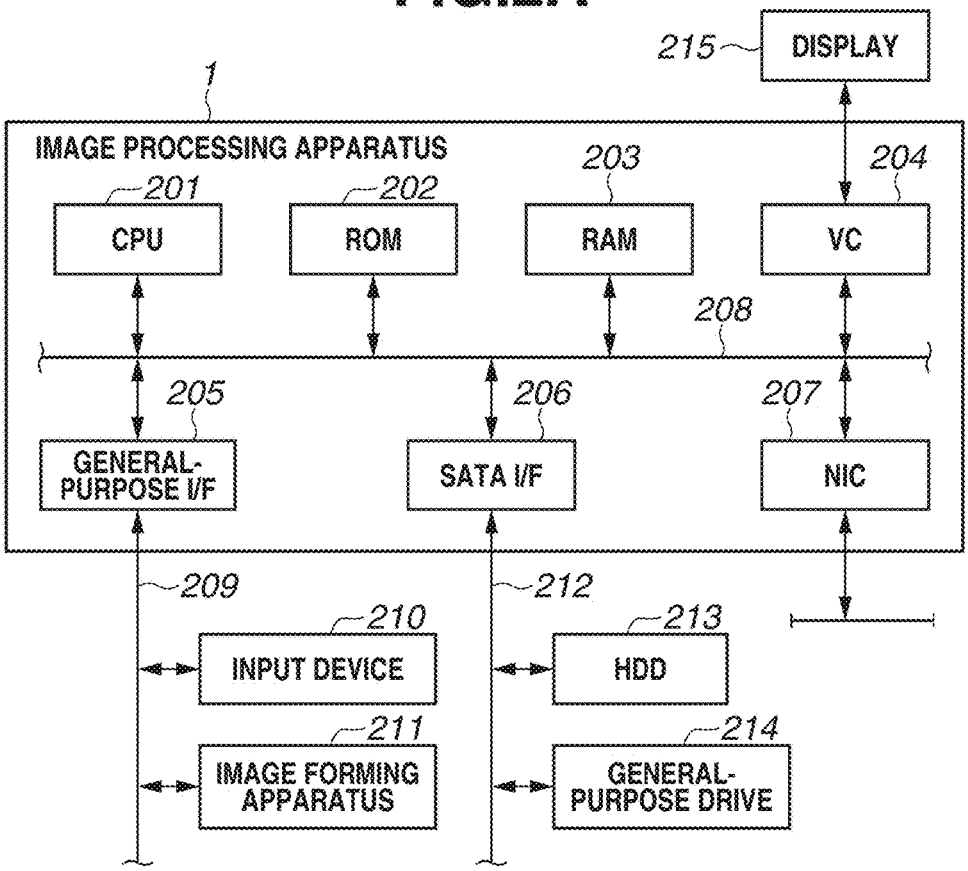
FIGS. 2A and 2B are diagrams each illustrating a configuration of an image processing apparatus 1.

A hardware configuration of an image processing apparatus 1 will be described with reference to FIG. 2A. The image processing apparatus 1 may be, for example, a computer, and includes a central processing unit (CPU) 201, a read only memory (ROM) 202, and a random access memory (RAM) 203. The CPU 201, which may include one or more processors and one or more memories, executes an operating system (OS) and various programs, which are stored in the ROM 202, a hard disk drive (HDD) 213, or the like, by using the RAM 203 as a work memory. Further, the CPU 201 controls each component through a system bus 208. Processing in flowcharts to be described below is executed by the CPU 201 by loading program code stored in the ROM 202, the HDD 213, or the like into the RAM 203. A display 215 is connected to a video card (VC) 204. An input device 210, such as a mouse or keyboard, and an image forming apparatus 211 are connected to a general-purpose interface (I/F) 205 through a serial bus 209. A general-purpose drive 214 that reads data from the HDD 213 or various recording media and writes data therein is connected to a serial ATA (SATA) I/F 206 through a serial bus 212. A network interface card (NIC) 207 receives information from an external device and outputs information thereto. The CPU 201 uses various recording media mounted on the HDD 213 or the general-purpose drive 214 as storage locations for various pieces of data. The CPU 201 displays on the display 215 a user interface (UI) to be provided by a program, and receives an input, such as a user instruction, through the input device 210.

<Logical Configuration of Image Processing Apparatus 1>

Figure 2B:
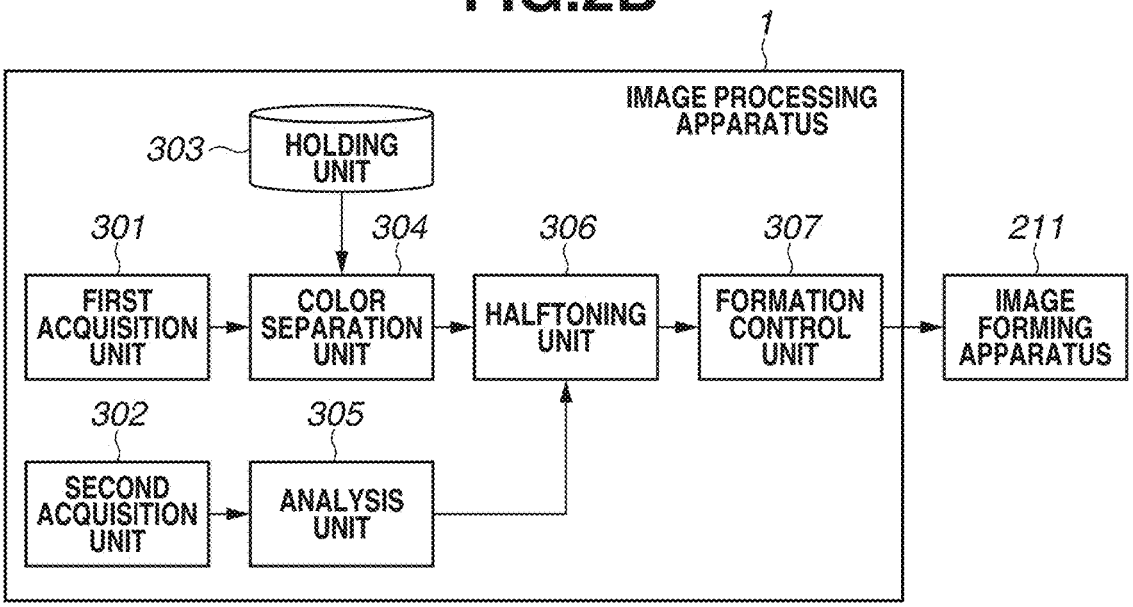

FIG. 2B is a diagram illustrating the logical configuration of the image processing apparatus 1 according to the first exemplary embodiment. The image processing apparatus 1 includes a first acquisition unit 301, a second acquisition unit 302, a holding unit 303, a color separation unit 304, an analysis unit 305, a halftoning unit 306, and a formation control unit 307.

The first acquisition unit 301 acquires image data representing an image to be formed on a recording medium. The second acquisition unit 302 acquires geometric data representing an uneven shape formed on the recording medium. The holding unit 303 holds a table, such as a color separation loop-up table (LUT), in which color information included in the image data and recording amounts of colored inks included in the image forming apparatus 211 are associated with each other. The color separation unit 304 performs color separation processing using the color separation LUT on the image data including the color information, thereby generating recording amount data representing the recording amount of colored inks. The analysis unit 305 analyzes the geometric data. The halftoning unit 306 performs halftoning on the recording amount data, thereby generating dot arrangement data corresponding to a dot arrangement of colored inks. The formation control unit 307 performs path decomposition of the dot arrangement represented by the dot arrangement data, thereby determining the arrangement of ink dots for each recording scan (path). The image forming apparatus 211 forms an uneven layer and an image layer on the recording medium based on the determined arrangement of ink dots for each recording scan (path). In the present disclosure, the recording medium is not particularly limited. Various types of materials such as paper, a plastic film, or the like, may be used as long as the materials are capable of formation of layers by the recording head.

<Configuration of Image Forming Apparatus 211>

Figure 3:
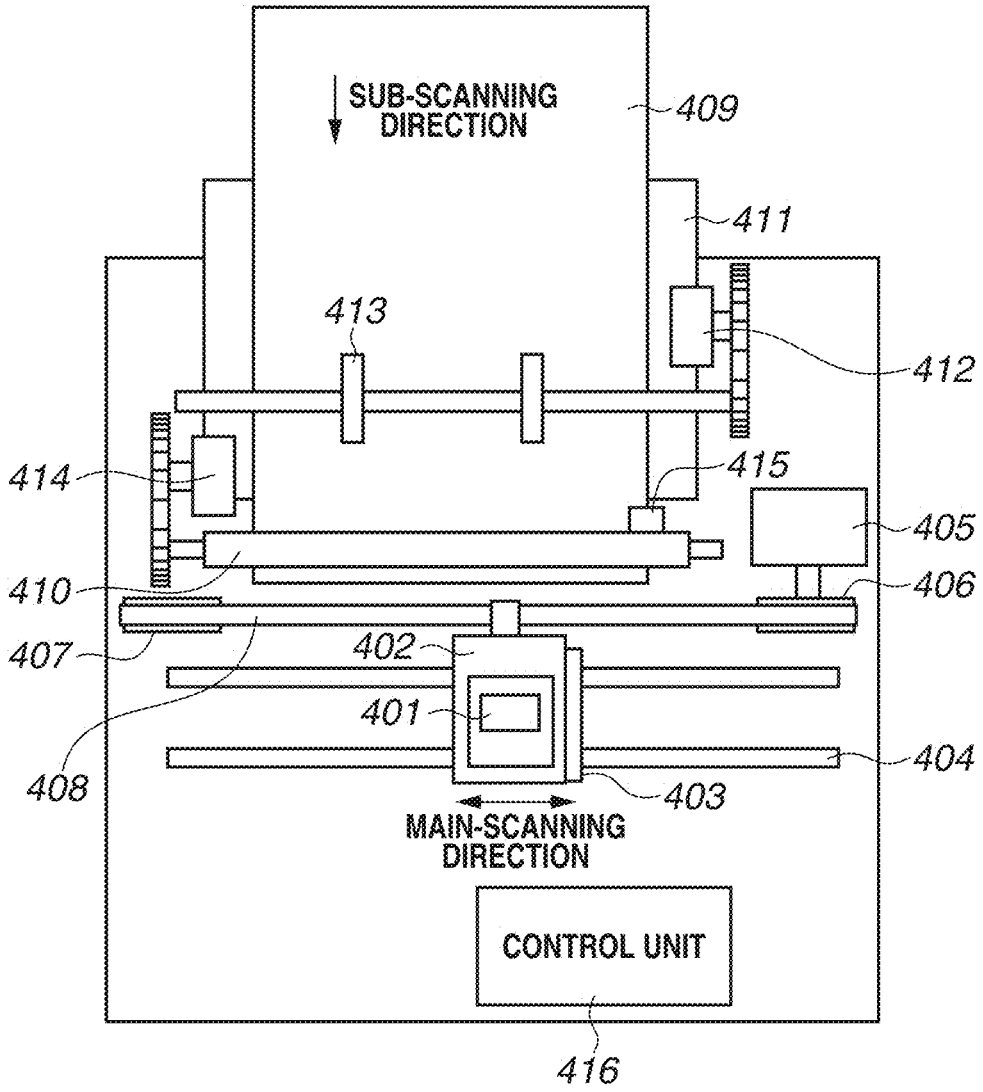
FIG. 3 is a diagram illustrating a configuration of an image forming apparatus 211.

FIG. 3 is the configuration diagram of the image forming apparatus 211. The image forming apparatus 211 is an inkjet printer that forms an uneven shape (uneven layer) by using ink and records colors (image layer) on the uneven shape. A head cartridge 401 includes a recording head including a plurality of discharge ports, and ink tanks for supplying ink to the recording head. The head cartridge 401 is provided with a connector for receiving a signal or the like for driving each discharge port of the recording head. Five types of ink tanks are independently provided as the ink tanks and respectively contain clear ink for forming the uneven layer, and colored inks of cyan, magenta, yellow, and black for forming the image layer. Each of these types of ink is UV ink to be cured when the ink is irradiated with ultraviolet (UV) light. As the clear ink, slightly colored ink or cloudy ink may be used. The head cartridge 401 is positioned and mounted on a carriage 402 so as to be replaceable, and the carriage 402 is provided with a connector holder for transmitting a drive signal or the like to the head cartridge 401 through the connector. An ultraviolet (UV) light irradiation device 403 is mounted on the carriage 402 and is controlled such that the discharged ink can be cured and fixed on the recording medium. The carriage 402 is movable in a reciprocating manner along a guide shaft 404. Specifically, the carriage 402 is driven through drive mechanisms, such as a motor pulley 406, a driven pulley 407, and a timing belt 408, by using a main scanning motor 405 as a drive source, and the position and movement of the carriage 402 are controlled. In the present exemplary embodiment, a movement of the carriage 402 along the guide shaft 404 is referred to as "main scanning" and the direction of the movement is referred to as a "main scanning direction". Recording media 409 such as print sheets are placed on an automatic sheet feeder (hereinafter referred to as ASF) 411. In the case of forming an uneven layer and an image layer, pickup rollers 413 are driven by a sheet feeding motor 412 and rotated through a gear, thereby allowing the recording media 409 to be separated one by one and fed from the ASF 411. Further, each recording medium 409 is conveyed to a recording start position facing a discharge port surface of the head cartridge 401 on the carriage 402 by the rotation of a conveyance roller 410. The conveyance roller 410 is driven through a gear by using a line feed (LF) motor 414 as a drive source. A determination as to whether the recording medium 409 is fed and a determination of the position of the recording medium 409 during sheet feeding are made when each of the recording medium 409 has passed through a paper end sensor 415. The head cartridge 401 mounted on the carriage 402 is held such that the discharge port surface protrudes downward from the carriage 402 and lies in parallel with the recording media 409. A control unit 416 includes a CPU and a storage unit. The control unit 416 receives data from an external device, and controls an operation of each part of the image forming apparatus 211 based on the received data.

The units described throughout the present disclosure are exemplary and/or preferable modules for implementing processes described in the present disclosure. The term "unit", as used herein, may generally refer to firmware, software, hardware, or other component, such as circuitry or the like, or any combination thereof, that is used to effectuate a purpose. The modules can be hardware units (such as circuitry, firmware, a field programmable gate array, a digital signal processor, an application specific integrated circuit or the like) and/or software modules (such as a computer readable program or the like). The modules for implementing the various steps are not described exhaustively above. However, where there is a step of performing a certain process, there may be a corresponding functional module or unit (implemented by hardware and/or software) for implementing the same process. Technical solutions by all combinations of steps described and units corresponding to these steps are included in the present disclosure.

<Operation for Forming an Uneven Layer and an Image Layer>

An operation for forming an uneven layer and an image layer on the recording medium 409 by the image forming apparatus 211 having the configuration illustrated in FIG. 3 will be described below. First, when the recording medium 409 is conveyed to a predetermined recording start position to form an uneven layer, the carriage 402 moves over the recording medium 409 along the guide shaft 404. During the movement, clear ink is discharged from the discharge ports of the recording head. The UV light irradiation device 403 radiates UV light along the movement of the recording head, thereby causing the discharged clear ink to be cured and fixed on the recording medium 409. When the carriage 402 moves to an end of the guide shaft 404, the conveyance roller 410 conveys the recording medium 409 by a predetermined amount in a direction vertical to a scanning direction of the carriage 402. In the present exemplary embodiment, the conveyance of the recording medium 409 is referred to as "paper feed" or "sub-scanning", and the direction of the conveyance is referred to as a "paper feed direction" or "sub-scanning direction". After the conveyance of the recording medium 409 by the predetermined amount is finished, the carriage 402 moves along the guide shaft 404 again. In this manner, scanning and paper feed by the carriage 402 of the recording head are repeatedly performed, thereby forming the uneven layer on the recording medium 409. After the uneven layer is formed, the conveyance roller 410 returns the recording medium 409 to the recording start position to discharge colored inks of cyan, magenta, yellow, and black on the uneven layer, thereby forming the image layer in a process similar to the process of forming the uneven layer.

In the present exemplary embodiment, for ease of explanation, the recording head is controlled by two values, i.e., whether to discharge ink dots. This applies to both the clear ink and the color inks. In the present exemplary embodiment, it is assumed that such an ink on/off control is performed on each of pixels defined by the output resolution of the image forming apparatus 211. Also it is assumed that a state where all pixels are turned on in a unit area is regarded as an ink recording amount of 100%. The term "on" used herein refers to discharge of ink dots and the term "off" used herein refers to discharge of no ink. A recording head capable of modulating the discharge amount of ink is generally used. Such a recording head can be applied if the above-descried binarization processing is extended to multi-value processing that realizes a plurality of levels at which the discharge amount of ink can be modulated. The present exemplary embodiment is therefore not limited to binarization.

During the formation of the uneven layer in the present exemplary embodiment, a height control in each position is performed by discharging clear ink as described above. If, in the formation of the uneven layer, a substantially uniform layer is formed with a clear ink recording amount of 100%, such a layer has a certain height according to the volume of the discharged clear ink. For example, when a layer formed with a recording amount of 100% has a height of 15 μm, a height of 75 μm can be reproduced by stacking five layers. That is, the recording amount of clear ink to be applied to a position where a height of 75 μm is desired is 500%.

Figure 4A:
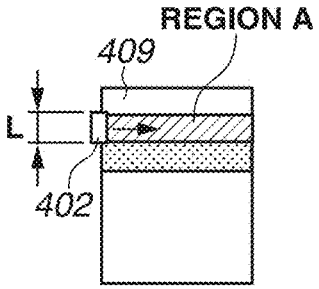
FIGS. 4A, 4B, 4C, 4D, and 4E are diagrams each illustrating an operation in which the image forming apparatus 211 forms an uneven layer and an image layer.
Figure 4B:
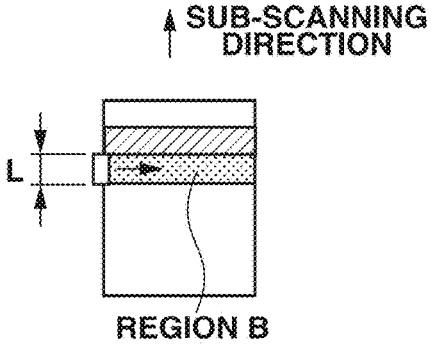

FIGS. 4A, 4B, 4C, 4D, and 4E each illustrate an operation in which the recording head scans over the recording medium 409 to form an uneven layer and an image layer. Main scanning by the carriage 402 forms a layer as much as a width L of the recording head. Each time recording of one line ends, the recording medium 409 is conveyed by a distance L in the sub-scanning direction. For ease of explanation, it is assumed that the image forming apparatus 211 in the present exemplary embodiment can only discharge ink up to the recording amount of 100% in one scan. To form a layer with an amount exceeding the recording amount of 100%, the same region is scanned a plurality of times without conveyance. For example, if the ink recording amount is 500% at the maximum, the same line is scanned five times. Referring to FIGS. 4A, 4B, 4C, 4D, and 4E, the recording head scans a region A five times (FIG. 4A) before the recording medium 409 is conveyed in the sub-scanning direction and main scanning of a region B is repeated five times (FIG. 4B).

Figure 4C:
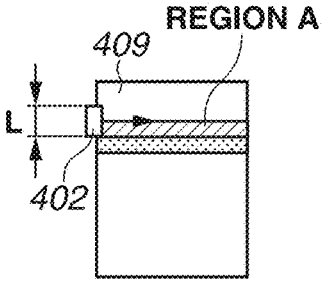
Figure 4D:
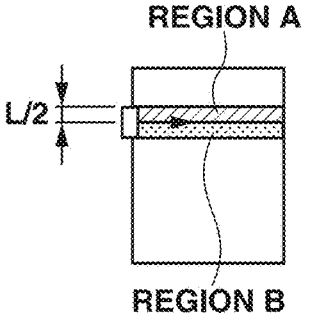
Figure 4E:
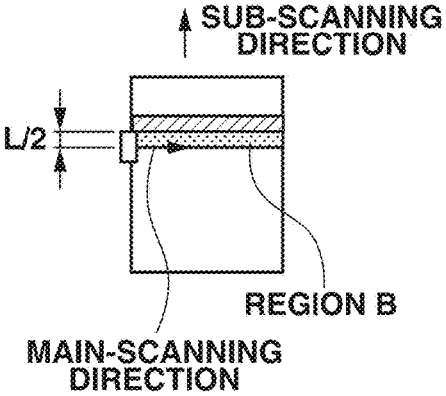

A plurality of scans may be performed even with a recording amount of 100% or less. In other words, multipath printing may be performed. FIGS. 4C to 4E each illustrate an example of two-path recording. In this example, an image as much as the width L of the recording head is formed by main scanning of the carriage 402. Each time recording of one line ends, the recording medium 409 is conveyed by a distance of L/2 in the sub-scanning direction. The region A is recorded by m-th main scanning (FIG. 4C) and (m+1)th main scanning (FIG. 4D) of the recording head. The region B is recorded by the (m+1)th main scanning (FIG. 4D) and (m+2)th main scanning (FIG. 4E) of the recording head.

While a two-path recording operation is described herein, the number of paths for recording may be changed according to desired accuracy. To perform n-path recording, for example, the recording medium 409 is conveyed in the sub-scanning direction by a distance of L/N each time recording of one line ends. In this case, even with a recording amount of 100% or less, a print pattern is divided into a plurality of print patterns, and the recording head performs n main scans over the same line of the recording medium 409, to thereby form an uneven layer and an image layer. In the present exemplary embodiment, the recording medium 409 is not particularly limited. Various types of materials such as paper, a plastic film, or the like, may be used as long as the materials are capable of formation of layers by the recording head.

<Flow of Processing to be Executed by the Image Processing Apparatus 1>

Figure 5:
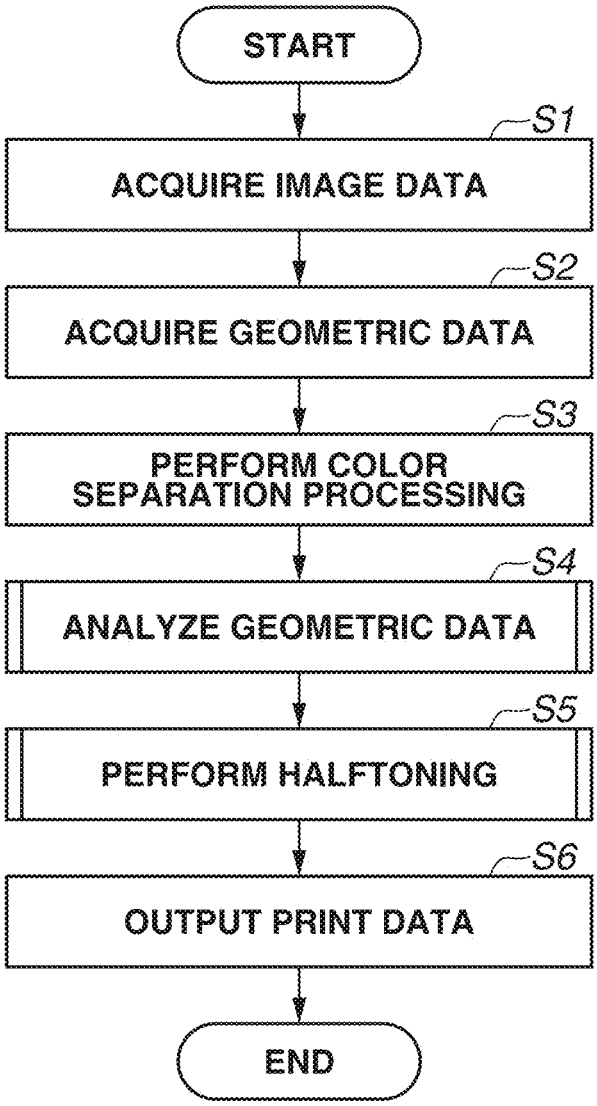
FIG. 5 is a flowchart illustrating processing to be executed by the image processing apparatus 1.

FIG. 5 is a flowchart illustrating the flow of processing to be executed by the image processing apparatus 1.

In step S1, the first acquisition unit 301 acquires image data obtained by recording RGB values for each pixel as color information. In the image data, color information Rφ1, color information Gφ1, and color information Bφ1 representing a color visually recognized when the print product is observed from the viewpoint 1 are recorded on each pixel, and color information Rφ1, color information Gφ1, and color information Bφ1 representing a color visually recognized when the print product is observed from the viewpoint 2 are recorded for each pixel. In other words, the image data acquired by the first acquisition unit 301 is six-channel image data obtained by recording color information indicating two different colors for each pixel. Assume herein that Rφ1, Gφ1, Bφ1, Rφ2, Gφ2, and Bφ2 represent RGB values defined on an sRGB space. The color information represented by the image data may indicate RGB values defined on an Adobe RGB space, L*a*b* values defined on an L*a*b* space, XYZ values which are color tristimulus values, a spectral reflectance, or the like. The number of pieces of image data acquired in step S1 is not limited to one. For example, three-channel image data obtained by recording pixel values Rφ1, Gφ1, and Bφ1 for each pixel and three-channel image data obtained by recording pixel values Rφ2, Gφ2, and Bφ2 for each pixel may be acquired.

In step S2, the second acquisition unit 302 acquires geometric data obtained by recording, for each pixel, height information indicating the height of the uneven shape to be formed on the recording medium 409. In the present exemplary embodiment, as the shape represented by the geometric data, a pattern in which the unevenness is repeatedly formed in a predetermined direction as illustrated in FIG. 1A is used. However, any uneven shape may be used as long as the print product can be formed in such a manner that color appearances vary when the observation angle is changed in an azimuth angle direction. For example, the uneven shape may be used which is formed by arranging a plurality of projected portions in such a manner that the aspect ratios of bottom surfaces thereof vary for each region of an image.

In step S3, the color separation unit 304 acquires the color separation LUT from the holding unit 303, and performs, on the image data, color separation processing expressed by Expression (1) using the acquired color separation LUT, thereby generating recording amount data representing recording amounts CMYK of colored inks.

$$C(\text{cyan})=\text{LUT}_C(R,G,B)$$

$$M(\text{magenta})=\text{LUT}_M(R,G,B)$$

$$Y(\text{yellow})=\text{LUT}_Y(R,G,B)$$

$$K(\text{black})=\text{LUT}_K(R,G,B) \quad (1)$$

where $\text{LUT}_C$, $\text{LUT}_M$, $\text{LUT}_Y$, and $\text{LUT}_K$ each represent the color separation LUT for the corresponding colored ink. The color separation processing may be performed using one color separation LUT in which RGB values and CMYK values are associated with each other, instead of using the color respective separation LUTs for CMYK colors.

If the resolution of image data including color information is different from the resolution of geometric data including height information, the resolution of image data and the resolution of geometric data are matched before the color separation processing is executed. A known method, such as a nearest neighbor method or a bilinear method, is used for resolution conversion.

In step S4, the analysis unit 305 analyzes the geometric data acquired in step S2. The processing of step S4 will be described in detail below. In step S5, the halftoning unit 306 performs halftoning according to the analysis result of the geometric data. The processing of step S5 will be described in detail below. In step S6, the formation control unit 307 performs path decomposition of the dot arrangement represented by the dot arrangement data obtained in step S5, thereby determining the arrangement of ink dots for each recording scan (path). Further, print data representing the arrangement of ink dots for each recording scan (path) is transmitted to the image forming apparatus 211. A parameter associated with the use of clear ink is calculated based on the geometric data and the calculated parameter is transmitted to the image forming apparatus 211, and then the processing is terminated. In this case, the parameter associated with the use of clear ink indicates the recording amount of clear ink, or the dot arrangement for each path of clear ink. The parameter may be calculated using a table in which the height represented by the geometric data is associated with the parameter.

<Processing Executed by the Analysis Unit 305 in Step S4>

Figure 6:
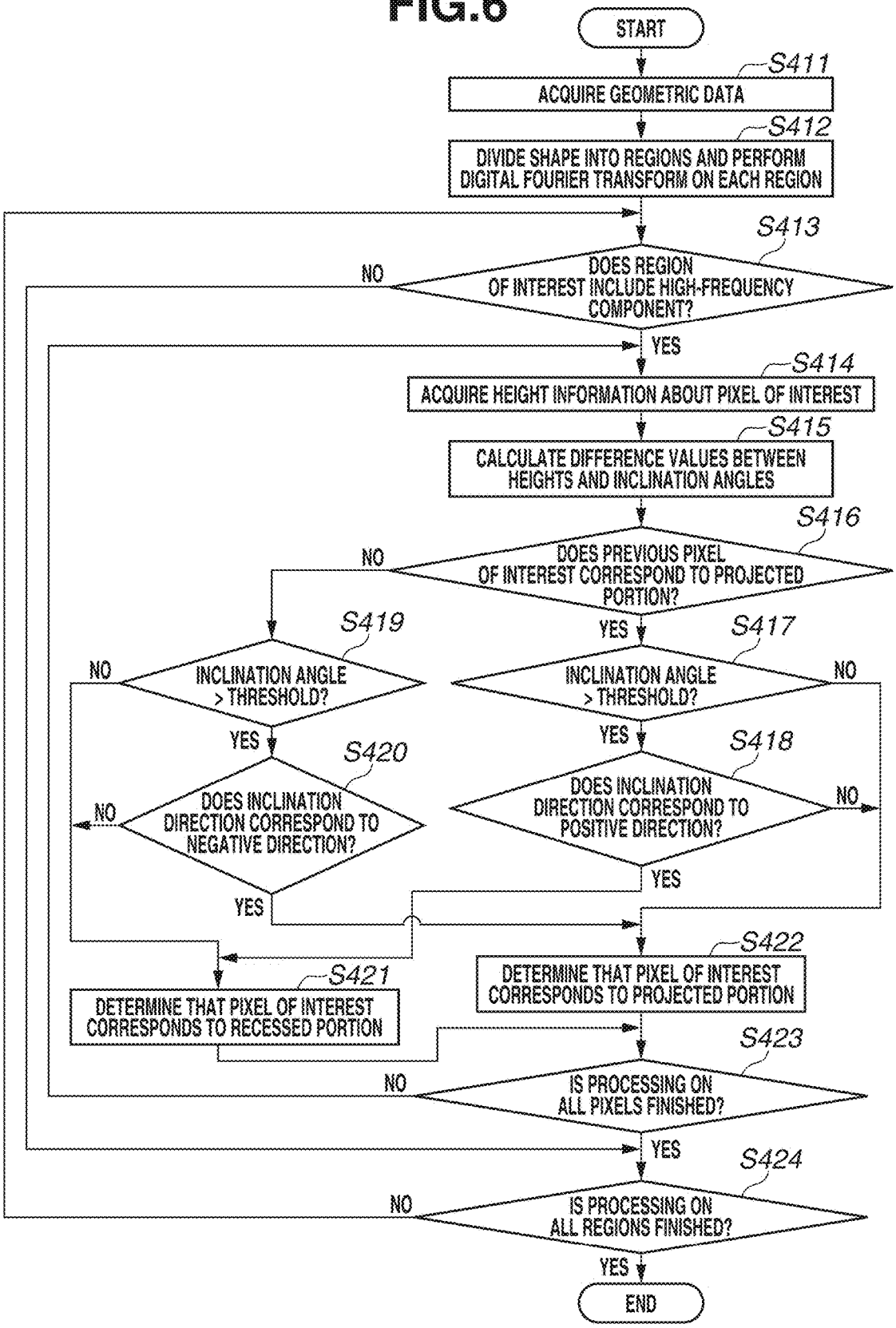
FIG. 6 is a flowchart illustrating processing for analyzing geometric data.

FIG. 6 is a flowchart illustrating processing to be executed by the analysis unit 305 in step S4.

In step S411, the geometric data obtained in step S2 is acquired. In step S412, the shape represented by the geometric data acquired in step S411 is divided into a plurality of regions (blocks) and digital Fourier transform is performed on each of the divided regions. In the present exemplary embodiment, the shape is divided into blocks each having 32 pixels in the vertical direction and 32 pixels in the horizontal direction. However, the size of each block is not limited to this example. The shape may be divided into regions after Fourier transform is performed on the entire geometric data.

In step S413, it is determined whether one region (region of interest) from among the regions obtained by dividing the shape into regions in step S412 includes a high-frequency component. If the region includes a high-frequency component (YES in step S413), the processing proceeds to step S414. If the region includes no high-frequency component (NO in step S413), it is determined that the region of interest has no unevenness, and flag information "0" indicating that the region does not correspond to a projected portion is recorded for each pixel of the region of interest, and then the processing proceeds to step S424. The determination as to whether the region includes a high-frequency component may be made by determining whether a frequency obtained by Fourier transform is higher than a predetermined threshold.

In step S414, height information about a pixel of interest in the pixels of the region that is determined to include a high-frequency component in step S413 is acquired. In step S415, difference values $h_a(x,y)$ and $h_b(x,y)$ between the height indicated by the height information about the pixel of interest and the height indicated by the height information about the adjacent pixel (previous pixel of interest), and inclination angles $\theta_a$ and $\theta_b$ are calculated by Expression (2).

$$h_a(x, y) = h(x-1, y) - h(x, y) \quad (2)$$

$$h_b(x, y) = h(x, y-1) - h(x, y)$$

$$\theta_a = \tan^{-1}\frac{h_a}{D}, \theta_b = \tan^{-1}\frac{h_b}{D}$$

where h(x,y) represents the height of a pixel position (x,y); $h_a(x,y)$ and $h_b(x,y)$ each represent a difference value between the height of the pixel of interest and the height of the adjacent pixel; D represents a distance between the pixel of interest and the adjacent pixel; and $\theta_a$ and $\theta_b$ each represent an inclination angle from the height of the pixel of interest to the height of the adjacent pixel. As the distance D, a value determined depending on the printer resolution is preliminarily stored in a storage device such as the HDD 213 and the stored value is used.

In step S416, it is determined whether the previous pixel of interest is a region corresponding to a projected portion. If the previous pixel of interest is a region corresponding to a projected portion (YES in step S416), the processing proceeds to step S417. If the previous pixel of interest is a region corresponding to a recessed portion (NO in step S416), the processing proceeds to step S419. The determination for a first pixel of interest is made by comparing the height of the pixel of interest with the height of the adjacent pixel. It may be determined whether the pixel of interest is a region corresponding to a projected portion or a recessed portion by comparing the height of the pixel of interest with an average value of heights of all pixels in the geometric data.

In step S417, it is determined whether the inclination angles $\theta_a$ and $\theta_b$ are larger than a predetermined threshold. If the inclination angles are larger than the threshold (YES in step S417), the processing proceeds to step S418. If the inclination angles are equal to or less than the threshold (NO in step S417), it is determined that the inclination is small and the pixel of interest corresponds to the same projected portion as the previous region of interest, and thus the processing proceeds to step S422. In step S418, it is determined whether the inclination direction corresponds to a positive direction by referring to the height difference values $h_a(x,y)$ and $h_b(x,y)$. The term "positive direction" used herein refers to a direction in which the inclination from the shape having the height of the pixel of interest to the shape having the height of the adjacent pixel increases. The term "negative direction" used herein refers to a direction in which the inclination from the shape having the height of the pixel of interest to the shape having the height of the adjacent pixel decreases. If the inclination direction corresponds to the positive direction (YES in step S418), the processing proceeds to step S421. If the inclination direction corresponds to the negative direction (NO in step S418), the processing proceeds to step S422.

In step S419, it is determined whether the inclination angles $\theta_a$ and $\theta_b$ are larger than a predetermined threshold. If the inclination angles are larger than the threshold (YES in step S419), the processing proceeds to step S420. If the inclination angles are equal to or less than the threshold (NO in step S419), it is determined that the inclination is small and the pixel of interest is corresponds to the same recessed portion as the previous region of interest, and thus the processing proceeds to step S421. In step S420, it is determined whether the inclination direction corresponds to the negative direction by referring to the height difference values $h_a(x,y)$ and $h_b(x,y)$. If the inclination direction corresponds to the negative direction (YES in step S420), the processing proceeds to step S422. If the inclination direction corresponds to the positive direction (NO in step S420), the processing proceeds to step S421.

In step S421, it is determined that the pixel of interest is located in a region corresponding to a recessed portion region, and thus flag information "0" indicating that the pixel of interest is not located in a region corresponding to a projected portion is recorded on the pixel of interest. In step S422, it is determined that the pixel of interest is located in a region corresponding to a projected portion, and thus flag information "1" indicating that the pixel of interest is located in a region corresponding to a projected portion is recorded on the pixel of interest.

In step S423, it is determined whether the determination as to whether the pixel of interest is located in a region corresponding to a projected portion or a recessed portion has been made on all pixels of the region that is determined to include a high-frequency component. If it is determined that the determination has been made (YES in step S423), the processing proceeds to step S424. If it is determined that the determination has not been made (NO in step S423), the processing returns to step S414 to proceed the processing. In step S424, it is determined whether processing has been performed on all regions obtained by dividing the shape into regions in step S412. If processing has been performed (YES in step S424), the processing ends. If processing has not been performed (NO in step S424), the processing returns to step S413 to proceed the processing.

In the present exemplary embodiment, the flag information about the unevenness is represented by two values assuming that the uneven shape is formed of recessed portions and projected portions like in the parallel line pattern described above. However, a step number may be given to flag information by referring to height information, to thereby deal with the geometric data in which projected portions are continuously formed.

<Processing to be Executed by the Halftoning Unit 306 in Step S5>

Figure 7:
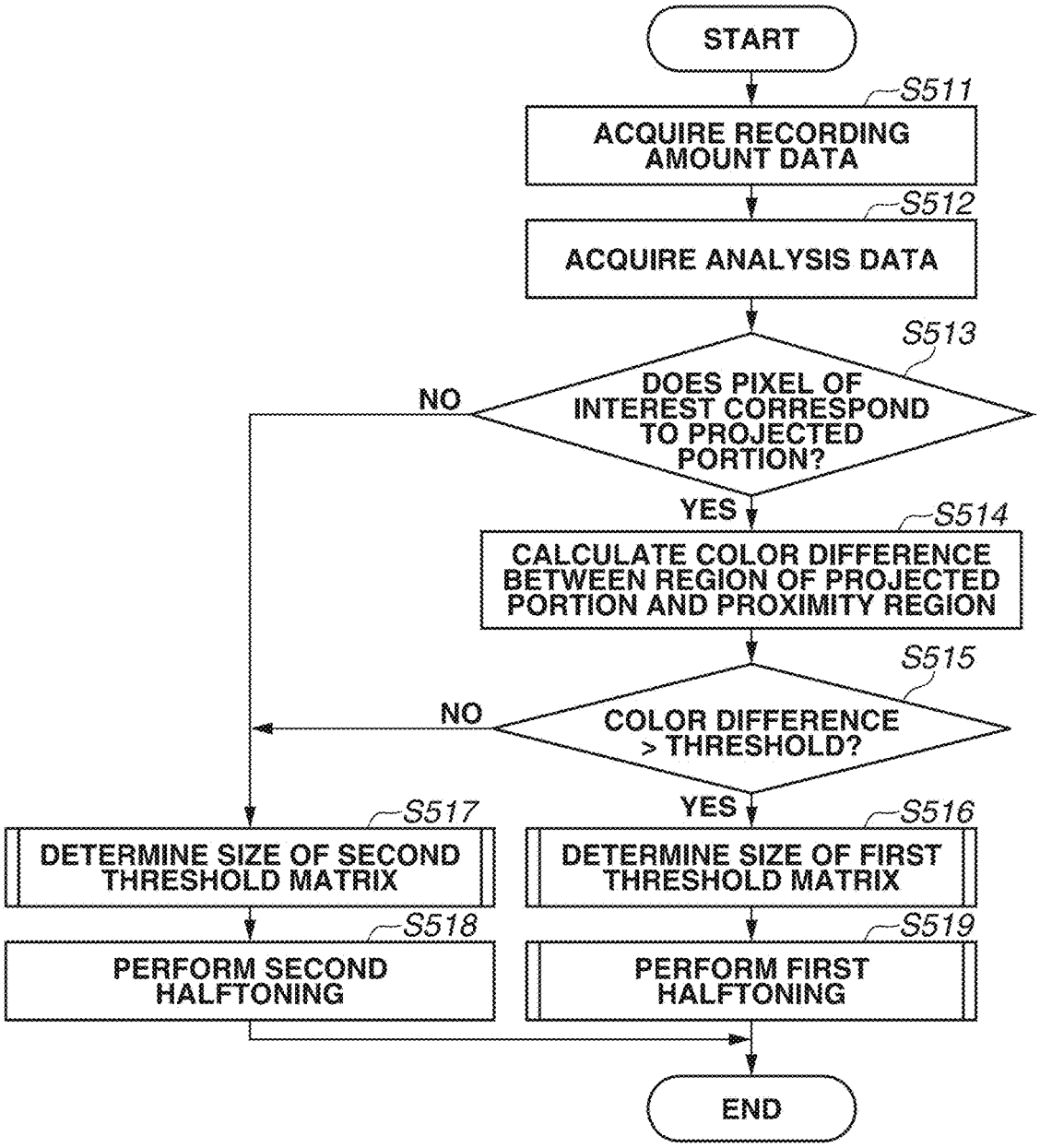
FIG. 7 is a flowchart illustrating halftone processing.

FIG. 7 is a flowchart illustrating processing to be executed by the halftoning unit 306 in step S5.

In step S511, the colored ink recording amount data generated in step S3 is acquired. In step S512, analysis data obtained by analyzing the geometric data in step S4 is acquired. As illustrated in FIG. 9A, flag information indicating the analysis result is recorded for each pixel of the geometric data as the analysis data. The flag information is indicated by two values, i.e., flag information 1 indicating a projected portion and flag information 0 indicating a recessed portion. In step S513, it is determined, based on the analysis data, whether the pixel of interest in the recording amount data is a region corresponding to a projected portion. If the pixel of interest is a region corresponding to a projected portion (YES in step S513), the processing proceeds to step S514. If the pixel of interest is not a region corresponding to a projected portion (NO in step S513), the processing proceeds to step S517.

In step S514, a color difference between the region corresponding to the projected portion and a region in proximity to the region is calculated using the recording amount of the pixel of interest and the recording amount corresponding to a boundary position between the region corresponding to the projected portion determined to include the pixel of interest in the recording amount data in step S513 and the other region. As the recording amount corresponding to the boundary position, the recording amount of a pixel closest to the pixel of interest in the boundary position may be used. In the present exemplary embodiment, the recording amounts CMYK represented by the recording amount data are converted into L*a*b* values by referring to the LUT in which the recording amounts of colored inks and color values (L*a*b* values) are associated with each other, and a Euclidean distance on the L*a*b* space is calculated as the color difference. As the recording amount corresponding to the boundary position, statistics such as an average value or a maximum value of pixel values in the boundary position may be used. The boundary position may be identified by referring to the analysis data.

In step S515, it is determined whether the color difference calculated in step S514 is larger than a predetermined threshold. If the color difference is larger than the threshold (YES in step S515), the processing proceeds to step S516. If the color difference is equal to or less than the threshold (NO in step S515), the processing proceeds to step S517. In the present exemplary embodiment, a numerical value 3 is used as a threshold, but instead other values may also be used. For example, the threshold for color difference may be set based on allowable color differences defined by The Color Science Association of Japan. When the threshold is set in such a manner that color difference can be perceived by comparing adjacent colors, the threshold is set to a range from 0.8 to 1.6. When the threshold is set in such a manner that color difference is hardly perceived by comparing adjacent colors, the threshold is set to a range from 1.6 to 3.2. Further, when the threshold is set in such a manner that the adjacent colors can be handled as the same color at an impression level, the threshold is set to a range from 3.2 to 6.5.

In step S516, the size of a first threshold matrix for performing first halftoning on a region which corresponds to a projected portion and has a color difference from the proximity region that is larger than a predetermined threshold is determined. The first halftoning is halftoning for arranging a larger number of ink dots at the center of the projected portion than at edges of the projected portion. Processing of step S516 will be described in detail below.

In step S517, the size of a second threshold matrix for performing second halftoning on a region which corresponds to a recessed portion or a projected portion and has a color difference from the proximity region that is equal to or less than the predetermined threshold is determined. The second halftoning is halftoning for arranging ink dots discretely. The processing of step S517 will be described in detail below.

In step S518, the second halftoning using the second threshold matrix is executed on a region which corresponds to a recessed portion or a projected portion and has a color difference from the proximity region that is equal to or less than the predetermined threshold, to thereby generate second dot arrangement data. The dot arrangement data is binary data obtained by recording two values, i.e., "0" indicating discharge of ink and "1" indicating discharge of no ink, for each pixel. The second threshold matrix according to the present exemplary embodiment has blue noise characteristics. FIG. 9A illustrates the second threshold matrix of a dot dispersion type having blue noise characteristics.

In step S519, the first halftoning using the first threshold matrix is executed on a region which corresponds to a projected portion and has a color difference from the proximity region that is larger than the predetermined threshold, to thereby generate first dot arrangement data. FIG. 9A illustrates the first threshold matrix of a dot concentration type. In the first threshold matrix illustrated in FIG. 9A, since the region corresponding to the projected portion has a width of eight dots in the horizontal direction (x-axis direction), the center of the projected portion is a 2-dot-width region indicated by a threshold 1. The center of the projected portion is a region in which the ink recording amount is small and a first dot is placed. Each edge of the projected portion is a one-dot-width region indicated by a threshold 255. Each edge of the projected portion is a region in which the ink recording amount is high and a last dot is placed. Any matrix may be used as the first threshold matrix, as long as the threshold increases from the center of the projected portion toward the edges of the projected portion. For example, as illustrated in FIG. 9B, the threshold may be set to increase not only in the horizontal direction (x-axis direction), but also in the vertical direction (y-axis direction), or the threshold may be set to increase in a spiral manner from the center of the projected portion. Further, in the present exemplary embodiment, the position of the center of the projected portion corresponds to a central two-dot-width region among the eight dots, but the present exemplary embodiment is not limited to this example. For example, when the width of the projected portion is five (odd number of) dots, a central one-dot-width region may be set as the center of the projected portion.

In the processing of step S5 described above, when the size of the threshold matrix for the region including the pixel of interest is determined, the pixel of interest in a different region is selected to perform the processing of steps S513 to S519. The processing is repeated until halftoning is executed on all regions. The size of the threshold matrix and the threshold may be preliminarily determined based on image data and geometric data. In this case, the processing of steps S516 and S517 is not performed and halftoning is performed using the preliminarily determined threshold matrix.

<Processing to be Executed by the Halftoning Unit 306 in Steps S516 and S517>

Figure 8:
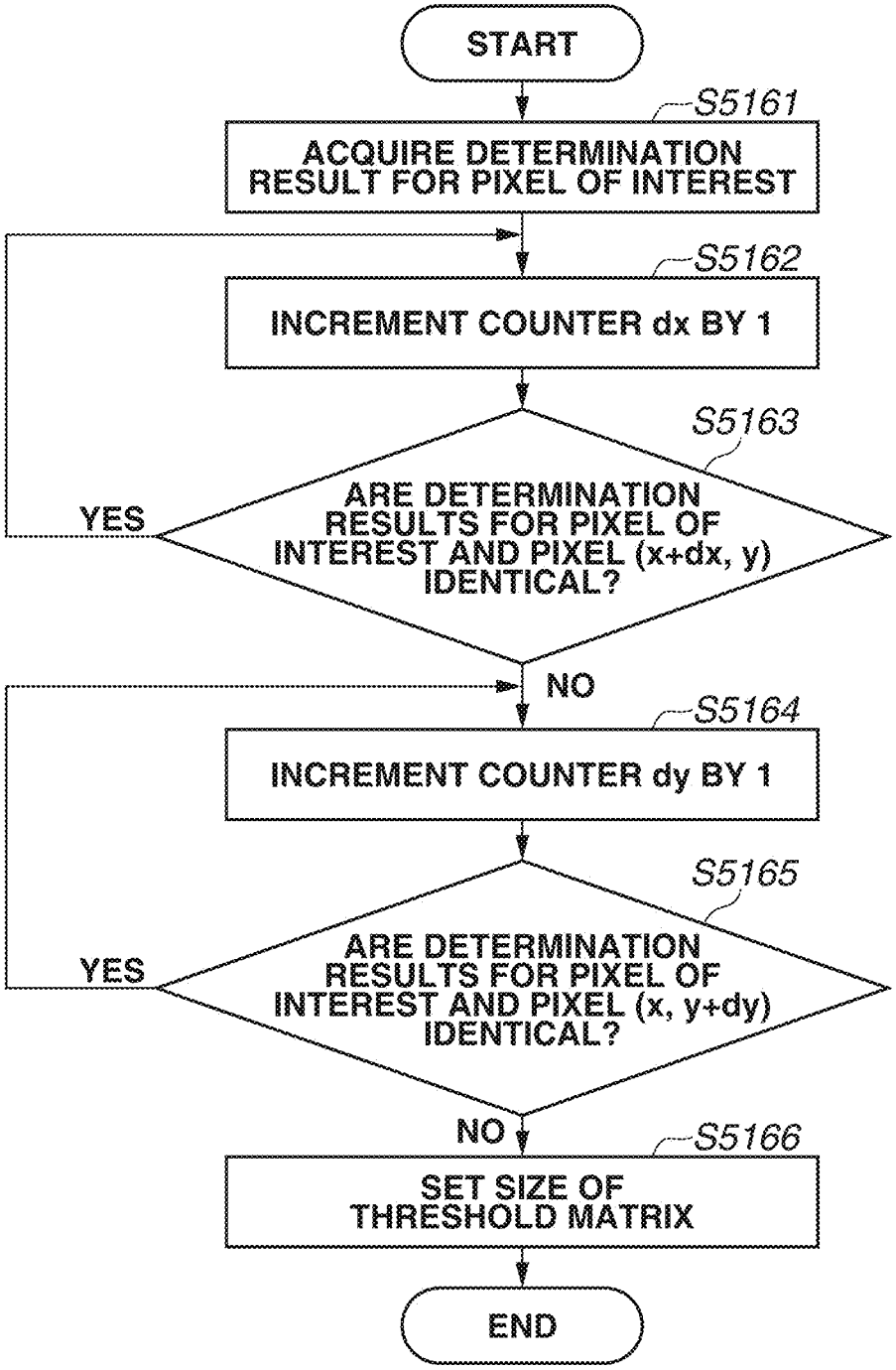
FIG. 8 is a flowchart illustrating processing for determining the size of a threshold matrix.

FIG. 8 is a flowchart illustrating processing to be executed by the halftoning unit 306 in steps S516 and S517. Regions that are continuously determined to be identical as a result of determination in steps S513 and S515 are calculated and the size of the regions is set as the size of the threshold matrix.

In step S5161, the determination results for the pixel of interest (x,y) determined in steps S513 and S515 are acquired. In step S5162, a counter dx is incremented by 1. In step S5163, it is determined whether the determination results are identical by referring to the determination result for the pixel of interest (x,y) and the determination result for the pixel (x+dx,y). If the determination results are identical (YES in step S5163), the processing returns to step S5162. If the determination results are not identical (NO in step S5163), the processing proceeds to step S5164. In step S5164, a counter dy is incremented by 1.

In step S5165, it is determined whether the determination results are identical by referring to the determination result for the pixel of interest (x,y) and the determination result for the pixel (x,y+dy). If the determination results are identical (YES in step S5165), the processing returns to step S5164. If the determination results are not identical (NO in step S5165), the processing proceeds to step S5166. In step S5166, the size of the threshold matrix is set to dx-1 in the horizontal direction and dy-1 in the vertical direction.

In the processing of steps S516 and S517, the region including the pixel of interest may be identified by performing edge detection on the analysis data by using a known Laplacian filter or the like.

As described above, according to the first exemplary embodiment, halftoning is performed such that a larger amount of colored ink can be recorded at the center of the projected portion than at edges of the projected portion when colored inks are recorded on the projected portion of the uneven shape, thereby improving the accuracy of reproducing colors of an anisotropic print product. In the present exemplary embodiment, halftoning is performed to prevent the colored printing material to be recorded on the surface of each projected portion from flowing into the surface of each recessed portion. Accordingly, the recording amount of the colored printing material to be recorded on each projected portion is not limited and thus colors can be reproduced with high saturation. One combination of recording amounts of colored inks for color information is predetermined, thereby eliminating the need for a table to hold a plurality of combinations of recording amounts.

The first exemplary embodiment illustrates a method for improving the color reproduction accuracy by setting the threshold matrix in which ink dots are concentrated on the center of each projected portion. A second exemplary embodiment illustrates an example in which a plurality of dots is superimposed at the center of each projected portion by path decomposition processing. Processing of step S6, which is a difference between the processing according to the second exemplary embodiment and the processing according to the first exemplary embodiment, will be mainly described below.

<Processing to be Executed by the Formation Control Unit 307 in Step S6>

Figure 10:
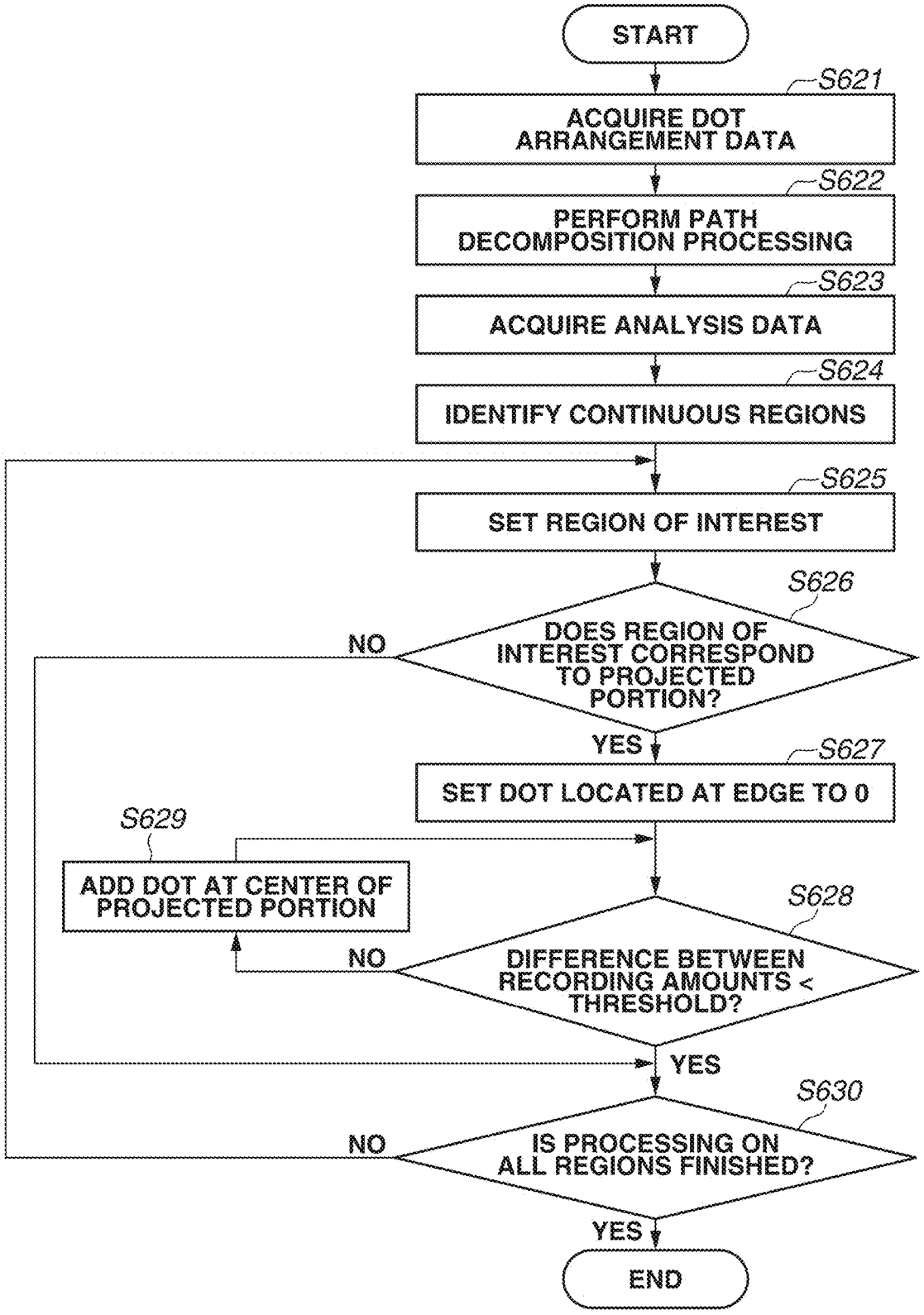

FIG. 10 is a flowchart illustrating processing to be executed by the formation control unit 307 in step S6.

In step S621, the colored ink dot arrangement data generated in step S5 is acquired. The dot arrangement data obtained herein is not limited to the data generated in step S5, but instead data obtained by performing known halftoning on recording amount data may be used. In step S622, path decomposition processing is performed based on the dot arrangement data. In the present exemplary embodiment, the path is decomposed into four paths. In step S623, the analysis data obtained by analyzing the geometric data in step S4 is acquired. In step S624, regions in which projected portions or recessed portions are continuously formed are identified by processing similar to the processing of steps S516 and S517. In step S625, the region of interest is set in the regions identified in step S624. In step S626, it is determined whether the region of interest is a region corresponding to a projected portion or a recessed portion by referring to the analysis data. If the region of interest is a region corresponding to a projected portion (YES in step S626), the processing proceeds to step S627. If the region of interest is a region corresponding to a recessed portion (NO in step S626), the processing proceeds to step S630.

In step S627, dots located at each edge (a boundary region between a projected portion and a recessed portion) of the projected portion are set to 0 in the dot arrangement for each path obtained by path decomposition processing in step S622. Instead of setting the dots arranged at edges of the projected portion to 0, a correction for reducing the number of dots by a predetermined number may be made. In step S628, a difference between the recording amount indicated by the recording amount data in the region of interest and the recording amount when colored inks are recorded according to the dot arrangement obtained by the processing of step S627 is calculated. If the difference value is smaller than a predetermined threshold (YES in step S628), the processing proceeds to step S630. If the difference value is equal to or greater than the threshold (No in step S628), the processing proceeds to step S629. In step S629, the number of dots located at the center of the region corresponding to the projected portion is increased and the processing returns to step S628.

In step S630, it is determined whether processing on all regions is finished. If the processing is finished (YES in step S630), the print data representing the dot arrangement of colored inks determined in step S6 and the parameter associated with the use of clear ink are transmitted to the image forming apparatus 211, and then the processing is terminated. If the processing is not finished (NO in step S630), the processing returns to step S625. The parameter associated with the use of clear ink is calculated based on the geometric data in step S630.

As described above, according to the second exemplary embodiment, path decomposition processing is performed to reduce the number of dots arranged at edges of each projected portion, thereby preventing colored inks recorded on each projected portion from flowing into each recessed portion. Consequently, the accuracy of reproducing colors of an anisotropic print product can be improved.

Figure 12:
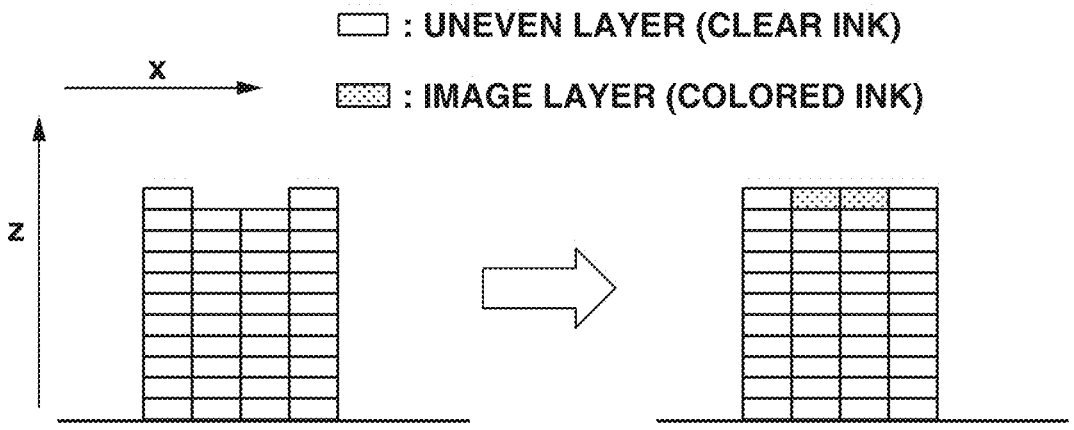
FIG. 12 is a schematic diagram illustrating the formation of an uneven layer and an image layer.

The first and second exemplary embodiments illustrate a method for improving the color reproduction accuracy by performing halftoning or path decomposition processing such that dots of colored inks are concentrated on the center of each projected portion. A third exemplary embodiment illustrates an example in which path decomposition processing is performed such that a larger amount of cleared ink is recorded at edges of each projected portion as illustrated in FIG. 12, thereby preventing the colored inks recorded on each projected portion from flowing into each recessed portion. Processing of step S6, which is a difference between the processing according to the third exemplary embodiment and the processing according to the first exemplary embodiment, will be mainly described below.

<Processing to be Executed by the Formation Control Unit 307 in Step S6>

Figure 11:
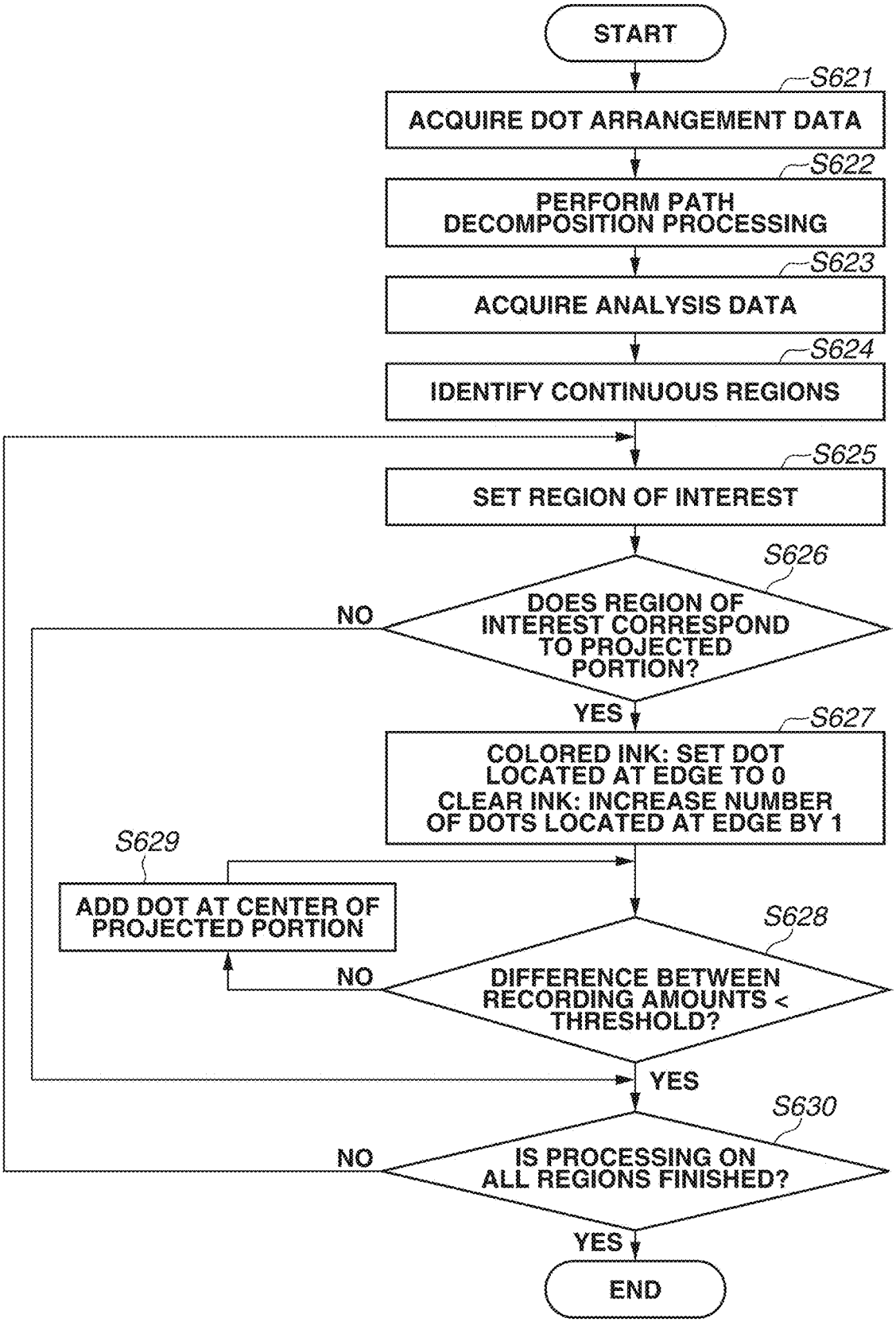
FIG. 11 is a flowchart illustrating path decomposition processing.

FIG. 11 is a flowchart illustrating processing to be executed by the formation control unit 307 in step S6.

In step S621, the colored ink dot arrangement data generated in step S5 is acquired. The dot arrangement data obtained here is not limited to the data generated in step S5, but instead data obtained by performing known halftoning on recording amount data may be used. Further, dot arrangement data on clear ink is acquired. The dot arrangement data on clear ink is generated in advance based on the geometric data. In step S622, path decomposition processing is performed based on the dot arrangement data. In the present exemplary embodiment, the path is decomposed into four paths. In step S623, the analysis data obtained by analyzing the geometric data in step S4 is acquired. In step S624, regions in which projected portions or recessed portions are continuously formed are identified by processing similar to the processing of steps S516 and S517. In step S625, the region of interest is set in the regions identified in step S624. In step S626, it is determined whether the region of interest is a region corresponding to a projected portion or a recessed portion by referring to the analysis data. If the region of interest is a region corresponding to a projected portion (YES in step S626), the processing proceeds to step S627. If the region of interest is a region corresponding to a recessed portion (NO in step S626), the processing proceeds to step S630.

In step S627, dots located at each edge (a boundary region between a projected portion and a recessed portion) of the projected portion are set to 0 in the dot arrangement for each path obtained by path decomposition processing in step S622. Further, the number of dots located at the edge of each projected portion is increased by 1 in the dot arrangement of clear ink. Instead of setting the dots of colored inks arranged at edges of each projected portion to 0, a correction for reducing the number of dots by a predetermined number may be made. In step S628, the difference between the recording amount indicated by the recording amount data in the region of interest and the recording amount when colored inks are recorded according to the dot arrangement obtained by processing in step S627 is calculated. If the difference value is smaller than a predetermined threshold (YES in step S628), the processing proceeds to step S630. If the difference value is equal to or greater than the threshold (NO in step S628), the processing proceeds to step S629. In step S629, the number of dots located at the center of the region corresponding to the projected portion is increased and the processing returns to step S628.

In step S630, it is determined whether processing on all regions is finished. If the processing is finished (YES in step S630), the print data representing the dot arrangement of the colored inks determined in step S6 and the parameter associated with the use of clear ink are transmitted to the image forming apparatus 211, and then the processing ends. If the processing is not finished (NO in step S630), the processing returns to step S625.

As described above, according to the third exemplary embodiment, a larger amount of clear ink is recorded at edges of each projected portion, thereby preventing the colored inks recorded on each projected portion from flowing into each recessed portion. Consequently, the color reproduction accuracy can be improved.

In the exemplary embodiments described above, halftoning and path decomposition processing are performed to prevent colored inks recorded on each projected portion from flowing into each recessed portion. A fourth exemplary embodiment illustrates an example in which in color separation processing, a combination of recording amounts of colored inks with which ink is less likely to flow into each recessed portion is selected from among a plurality of combinations of recording amounts of colored inks to be recorded on each projected portion. Processing of step S3, which is a difference between the processing according to the fourth exemplary embodiment and the processing according to the first exemplary embodiment, will be mainly described below. It is assumed that the image data acquired in step S1 according to the present exemplary embodiment includes CIE tristimulus values XYZ as color information. Specifically, color information XYZ1 indicating a color visually recognized when the print product is observed from the viewpoint 1 and color information XYZ2 indicating a color visually recognized when the print product is observed from the viewpoint 2 are recorded for each pixel.

<Processing to be Executed by the Color Separation Unit 304 in Step S3>

Figure 13:
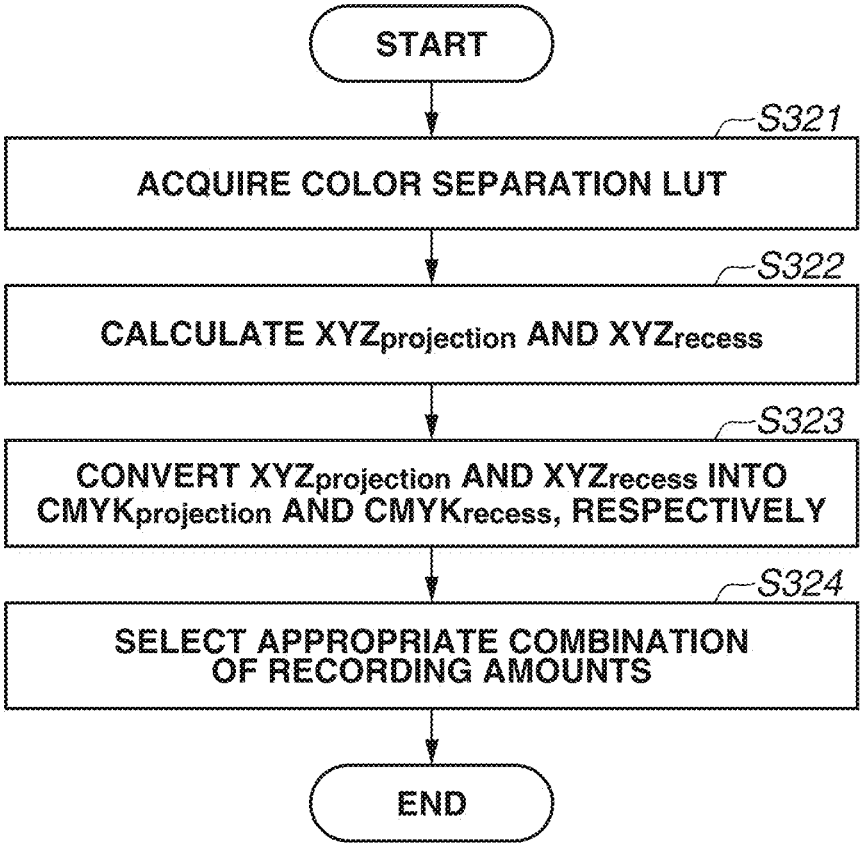
FIG. 13 is a flowchart illustrating color separation processing.

FIG. 13 is a flowchart illustrating processing to be executed by the color separation unit 304 in step S3.

In step S321, the color separation LUT is acquired. As illustrated in FIG. 14, the color separation LUT according to the present exemplary embodiment indicates colors (CIE tristimulus values XYZ) to be reproduced according to the recording amount of colored inks of C (cyan), M (magenta), Y (yellow), and K (black) mounted on the image forming apparatus 211. That is, the color separation LUT indicates data obtained by associating the recording amounts CMYK of colored inks with the CIE tristimulus values XYZ. The color separation LUT is created in advance by forming a patch on a recording medium while changing the recording amount of colored inks and measuring the colors in the formed patch, and the created color separation LUT is stored in a storage device such as the HDD 213.

Figure 15:
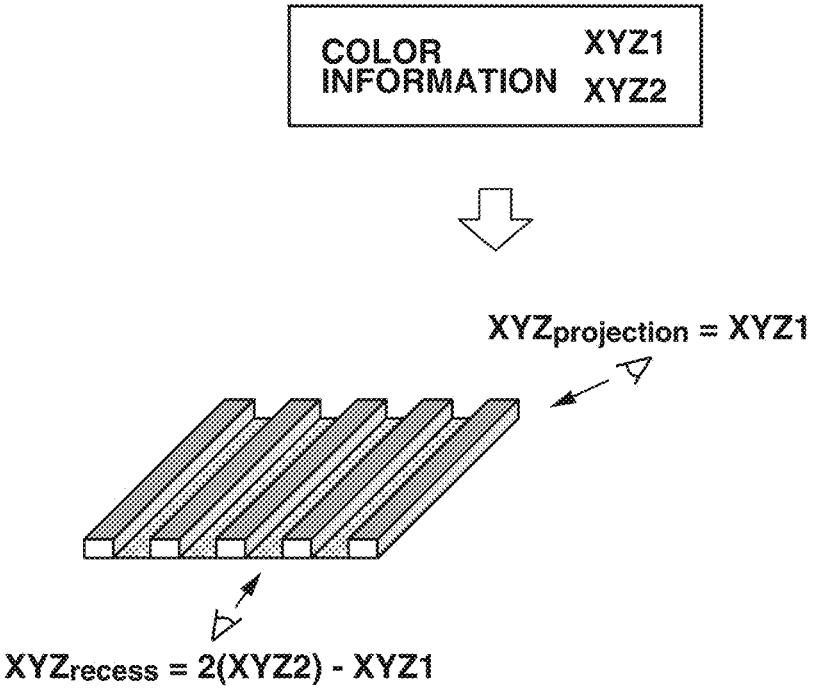
FIG. 15 is a diagram illustrating an example of a combination of recording amounts of colored inks.

In step S322, based on the color information indicated by the image data acquired in step S1, the color of colored ink to be recorded on a projected portion ($XYZ_{projection}$) and the color of colored ink to be recorded on a recessed portion ($XYZ_{recess}$) are calculated. As indicated by a combination 1 in FIG. 15, in order to reproduce the color (XYZ1) indicated by the color information from the viewpoint 1 and the color (XYZ2) indicated by the color information from the viewpoint 2, it is necessary to represent the color XYZ1 by the color ($XYZ_{projection}$) of colored ink recorded on each projected portion. It is also necessary to represent the color XYZ2 by a mixed color (($XYZ_{projection}$+$XYZ_{recess}$)/2) of the color of colored ink to be recorded on the projected portion and the color of colored ink to be recorded on the recessed portion. Accordingly, when the area of the projected portion and the area of the recessed portion are the same, $XYZ_{projection}$ and $XYZ_{recess}$ are calculated by Expression (3).

$$XYZ_{projection}=XYZ1$$

$$XYZ_{recess}=2(XYZ2)-XZY1 \quad (3)$$

In step S323, a recording amount $CMYK_{projection}$ of colored inks to be recorded on the projected portion and a recording amount $CMYK_{recess}$ of colored inks to be recorded on the recessed portion are acquired based on $XYZ_{projection}$ and $XYZ_{recess}$ calculated in step S322. A reverse lookup is performed using known interpolation processing, such as cubic interpolation or tetrahedral interpolation, from a color conversion table in FIG. 14. The color conversion table used here indicates CIE tristimulus values XYZ for the recording amount CMYK of colored inks, and is obtained by performing known under color removal (UCR) processing on the colored inks CMY. Accordingly, a plurality of recording amounts CMYK is obtained for XYZ. Therefore, in step S324, an appropriate combination of recording amounts is selected from among all candidates of acquired recording amounts CMYK for XYZ.

In step S324, an appropriate combination of recording amounts CMYK is selected from among candidates of recording amounts CMYK acquired in step S323. Specifically, for each projected portion, the recording amount $CMYK_{projection}$ with which the total recording amount of the recording amounts of colored inks to be recorded on each projected portion is minimum is selected to prevent the colored inks to be recorded on each projected portion from flowing into each recessed portion. For each recessed portion, the recording amount $CMYK_{recess}$ with which the total recording amount of the recording amounts of colored inks to be recorded on each recessed portion is minimum is selected to prevent a deterioration in granularity. In the present exemplary embodiment, the total recording amount is the total amount of recording amounts of C, M, Y, and K. By the processing described above, the colored inks to be recorded on each projected portion are less likely to flow into each recessed portion, so that the difference between colored to be reproduced is prevented from decreasing in two different directions and the visual recognition of a variation in color appearance according to the observation angle is facilitated.

As described above, in the printer having four types of colored inks, i.e., CMYK inks, mounted thereon, a plurality of combinations of recording amounts of colored inks is calculated by UCR processing. In the present exemplary embodiment, in the case of forming a print product having an uneven shape formed on a surface thereof by using the printer, a combination of colored inks with which the total recording amount is minimum is selected to reduce the recording amount of colored inks to be recorded on each projected portion. Thus, the ink recorded on each projected portion is less likely to flow into each recessed portion, so that a desired color can be reproduced with a high accuracy. In addition, colored inks are recorded on the uneven shape in such a manner that the colors vary when the colors are observed from different direction, thereby making it possible to reproduce the color anisotropy on the recording medium.

MODIFIED EXAMPLES

While the exemplary embodiments described above illustrate an example in which geometric data is analyzed to determine whether a region corresponds to a projected portion or a recessed portion, the present disclosure is not limited to the example. Geometric data for identifying projected portions and recessed portions in advance may be acquired, or mask data for identifying recessed portions and projected portions may be acquired separately from geometric data. In the case of acquiring mask data, threshold matrices used for halftoning are switched based on the mask data. When geometric data is generated in advance, the width of each projected portion is set to be larger than the width of each recessed portion, thereby preventing the ink recorded on each projected portion from flowing into each recessed portion.

The exemplary embodiments described above illustrate an example in which an uneven layer and an image layer are formed by employing an inkjet method. However, other recording methods such as an electrophotographic method may also be employed.

In the exemplary embodiments described above, halftoning is performed using a threshold matrix, but instead an error diffusion method may be used. In this case, a diffusion coefficient is determined in such a manner that an error is diffused only in a central region of each projected portion, by setting the recording amount corresponding to each edge of the projected portion to 0, or by adding dots to the center of the projected portion.

In the exemplary embodiments described above, UV ink is used as clear ink for forming the unevenness. However, the present disclosure is not limited to this example. For example, ink to be cured with light other than UV light, or ink to be cured with heat may also be used. The unevenness may be formed by shaving, and wood or metal other than resins may be used.

While in the exemplary embodiments described above, four types of colored inks of C, M, Y, and K are mounted on the image forming apparatus 211, the present disclosure is not limited to this example. Low-density inks, such as Lc (light cyan) and Lm (light magenta), may be used in addition to C, M, Y, and K inks. In this case, the number of combinations of recording amounts of colored inks is increased by performing color density decompositions for replacing Lc with C or replacing Lm with M. In the fourth exemplary embodiment, a combination of recording amounts of colored inks with which the total recording amount of colored inks is minimum may be selected from among the combinations. In place of the low-density inks, particular color inks such as R (red) ink, G (green) ink, and B (blue) ink may also be used.

In the exemplary embodiments described above, image data including information about colors to be reproduced when the print product is observed from two viewpoints with different azimuth angles is acquired. However, the present disclosure is not limited to this example. The appearance of the print product having an uneven shape formed on a surface thereof varies depending on a change in the elevation angle direction of the viewpoint. Accordingly, the image data may include information about colors to be reproduced when the print product is observed from two viewpoints with different elevation angles.

In the exemplary embodiments described above, colored inks are used as the colored printing material. However, the present disclosure is not limited to this example. For example, colored toner may be used as the colored printing material. Also, the printing material for forming the unevenness is not limited to clear ink, but instead clear toner may be used.

In the exemplary embodiments described above, the recording amount data is generated by performing color separation processing on the image data. However, the present disclosure is not limited to this example. The recording amount data generated based on the image data may be preliminarily stored in a storage device, such as the HDD 213, and the recording amount data may be acquired from the storage device and used. In this case, the image processing apparatus 1 does not acquire the image data and does not perform the color separation processing.

In the exemplary embodiments described above, height information is recorded for each pixel of the geometric data. However, any format may be used, as long as the uneven shape formed on a recording medium can be represented. For example, the normal direction of the surface of the shape may be recorded for each pixel. The geometric data may be point group data or polygon data.

The exemplary embodiments described above illustrate an example in which the parameter associated with the use of clear ink is calculated based on the geometric data. However, the present disclosure is not limited to the example. For example, the parameter associated with the use of clear ink calculated based on the geometric data may be preliminarily stored in a storage device such as the HDD 213, and the parameter may be acquired from the storage device and used.

In the exemplary embodiments described above, halftoning to be performed on each projected portion and halftoning to be performed on each recessed portion are switched. However, the first halftoning using the first threshold matrix of dot concentration type may be performed on both the projected portions and the recessed portions.

In the exemplary embodiments described above, data for recording colored inks on each projected portion and each recessed portion is generated. Colored inks may be recorded only on each projected portion, as long as the color to be reproduced on each projected portion is different from the color to be reproduced on each recessed portion. In this case, the color to be reproduced on each recessed portion corresponds to the color to be reproduced on a recording medium.

The fourth exemplary embodiment illustrates an example in which the recording amount $CMYK_{projection}$ with which the total recording amount of recording amounts of colored inks to be recorded on each projected portion is minimum is selected. However, any selection method may be used as long as the recording amount $CMYK_{projection}$ is selected according to a predetermined condition for preventing colored inks to be recorded on each projected portion from flowing into each recessed portion. For example, the recording amount $CMYK_{projection}$ with which an average viscosity is maximum may be selected. In consideration of a deterioration in the granularity of UCR processing, a combination of recording amounts with which the total recording amount is maximum may be selected from among the combinations with which the total recording amount is equal to or less than a predetermined threshold.

According to the present disclosure, it is possible to reproduce colors with a high accuracy on a recording medium having an uneven shape formed on a surface thereof, whereby the present disclosure improves image processing technology and provides a particular solution to a problem or a particular way to achieve a desired outcome.

OTHER EMBODIMENTS

Embodiment(s) of the present disclosure can also be realized by a computerized configuration(s) of a system or apparatus that read(s) out and execute(s) computer executable instructions (e.g., one or more programs) recorded on a storage medium (which may also be referred to more fully as a 'non-transitory computer-readable storage medium') to perform the functions of one or more of the above-described embodiment(s) and/or that include(s) one or more circuits (e.g., application specific integrated circuit (ASIC)) for performing the functions of one or more of the above-described embodiment(s), and by a method performed by the computerized configuration(s) of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computerized configuration(s) may comprise one or more processors, and one or more memories (e.g., central processing unit (CPU), micro processing unit (MPU)), and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2017-107453, filed May 31, 2017, which is hereby incorporated by reference herein in its entirety.

What is claimed is:

1. An image processing apparatus that generates data for setting different colors for a projected portion and a recessed portion of an unevenness on a surface of a recording medium by recording a colored printing material on at least the projected portion of the unevenness, the image processing apparatus comprising:

a first acquisition unit configured to acquire recording amount data representing a recording amount of the colored printing material; and a halftoning unit configured to perform first halftoning on the recording amount data to arrange a larger number of dots of the colored printing material to be recorded on the projected portion of the unevenness at a center of the projected portion than at edges of the projected portion.

2. The image processing apparatus according to claim 1, further comprising:

a second acquisition unit configured to acquire geometric data representing a shape of the unevenness; and an analysis unit configured to analyze the geometric data to determine whether a region of interest in the unevenness is a region on which the first halftoning is performed, wherein the halftoning unit performs the first halftoning based on a result of the determination by the analysis unit.

3. The image processing apparatus according to claim 1, further comprising:

a second acquisition unit configured to acquire geometric data representing a shape of the unevenness; and an analysis unit configured to analyze the geometric data to determine whether a region of interest in the unevenness is a region corresponding to the projected portion of the unevenness, or a region corresponding to the recessed portion of the unevenness, wherein when the analysis unit determines that the region of interest is the region corresponding to the projected portion, the halftoning unit performs the first halftoning on a region corresponding to the region of interest in the recording amount data.

4. The image processing apparatus according to claim 3, wherein when the analysis unit determines that the region of interest is the region corresponding to the recessed portion, the halftoning unit performs second halftoning for arranging dots of the colored printing material discretely in a region corresponding to the region of interest in the recording amount data.

5. The image processing apparatus according to claim 4, wherein when the analysis unit determines that the region of interest is the region corresponding to the projected portion, the analysis unit calculates a difference between a color to be recorded in the region of interest and a color to be recorded in a region in proximity to the region of interest, with the colored printing material, and determines whether the difference is greater than a predetermined threshold, and when the analysis unit determines that the difference is greater than the predetermined threshold, the halftoning unit performs the first halftoning on a region corresponding to the region of interest in the recording amount data, and when the analysis unit determines that the difference is equal to or less than the predetermined threshold, the halftoning unit performs the second halftoning on the region corresponding to the region of interest in the recording amount data.

6. The image processing apparatus according to claim 1, wherein the halftoning unit performs the first halftoning on the recording amount data by using a threshold matrix for arranging a larger number of dots of the colored printing material to be recorded on the projected portion at a center of the projected portion than at edges of the projected portion.

7. The image processing apparatus according to claim 1, further comprising:

a third acquisition unit configured to acquire information indicating two different colors for each region of the unevenness; and a color separation unit configured to generate the recording amount data based on the color information, wherein the first acquisition unit acquires the recording amount data generated by the color separation unit.

8. The image processing apparatus according to claim 7, wherein the color separation unit selects one combination of recording amounts of the colored printing material according to a predetermined condition from among a plurality of combinations of recording amounts of the colored printing material, to determine the recording amount of the colored printing material to be recorded in a region of interest, and generates the recording amount data representing the determined recording amount.

9. The image processing apparatus according to claim 8, wherein the color separation unit selects a combination of recording amounts of the colored printing material with which a total recording amount of the colored printing material to be recorded in the region of interest is minimum, from among a plurality of combinations of recording amounts of the colored printing material, to determine the recording amount of the colored printing material to be recorded in the region of interest, and generates the recording amount data representing the determined recording amount.

10. The image processing apparatus according to claim 8, wherein the color separation unit selects a combination of recording amounts of the colored printing material with which a total recording amount of the colored printing material to be recorded in the region of interest is maximum, from among combinations of recording amounts of the colored printing material with which the total recording amount of the colored printing material to be recorded in the region of interest is equal to or less than a predetermined threshold, in the plurality of combinations of recording amounts of the colored printing material, to determine the recording amount of the colored printing material to be recorded in the region of interest, and generates the recording amount data representing the determined recording amount.

11. The image processing apparatus according to claim 8, wherein the color separation unit selects a combination of recording amounts of the colored printing material with which an average viscosity of the colored printing material to be recorded in the region of interest is highest, from among a plurality of combinations of recording amounts of the colored printing material, to determine the recording amount of the colored printing material to be recorded in the region of interest, and generates the recording amount data representing the determined recording amount.

12. The image processing apparatus according to claim 1, further comprising a formation unit configured to record the colored printing material on the unevenness on the surface of the recording medium based on a result of the first halftoning.

13. The image processing apparatus according to claim 12, wherein the formation unit forms the unevenness on the recording medium by using a printing material for forming the unevenness on the recording medium, and then records the colored printing material on the unevenness based on the result of the first halftoning.

14. The image processing apparatus according to claim 12, wherein the printing material for forming the unevenness is one of a printing material to be cured with light or heat, wood, and metal.

15. The image processing apparatus according to claim 1, wherein the first acquisition unit acquires recording amount data representing an image including a plurality of pixels and obtained by recording a recording amount of the colored printing material in each of the pixels, the recording amount data is data for recording the colored printing material on the unevenness, and a recording amount corresponding to one of the projected portion and the recessed portion of the unevenness is recorded on each of the pixels of the image represented by the recording amount data, each edge of the projected portion is a region in proximity to a boundary between a region corresponding to the projected portion and a region corresponding to the recessed portion in the region corresponding to the projected portion in the image represented by the recording amount data, and the center of the projected portion is a region other than the proximity region of the boundary in the region corresponding to the projected portion in the image represented by the recording amount data.

16. An image processing method for generating data for setting different colors for a projected portion and a recessed portion of an unevenness on a surface of a recording medium by recording a colored printing material on at least the projected portion of the unevenness, the image processing method comprising:

acquiring recording amount data representing a recording amount of the colored printing material; and performing halftoning on the recording amount data to arrange a larger number of dots of the colored printing material to be recorded on the projected portion of the unevenness at a center of the projected portion than at edges of the projected portion.

17. A non-transitory computer-readable storage medium storing instructions that, when executed by a computer, cause the computer to perform an image processing method for generating data for setting different colors for a projected portion and a recessed portion of an unevenness on a surface of a recording medium by recording a colored printing material on at least the projected portion of the unevenness, the image processing method comprising:

acquiring recording amount data representing a recording amount of the colored printing material; and performing halftoning on the recording amount data to arrange a larger number of dots of the colored printing material to be recorded on the projected portion of the unevenness at a center of the projected portion than at edges of the projected portion.

18. An image processing apparatus that generates data for setting different colors for a projected portion and a recessed portion of an unevenness on a surface of a recording medium by recording a colored printing material on at least the projected portion of the unevenness, the image processing apparatus comprising:

an acquisition unit configured to acquire dot arrangement data corresponding to a dot arrangement of the colored printing material on the recording medium; and a path decomposition unit configured to perform path decomposition processing on the dot arrangement data to arrange a larger number of dots of the colored printing material to be recorded on the projected portion of the unevenness at a center of the projected portion than at edges of the projected portion.

19. An image processing method for generating data for setting different colors for a projected portion and a recessed portion of an unevenness on a surface of a recording medium by recording a colored printing material on at least the projected portion of the unevenness, the image processing method comprising:

acquiring dot arrangement data corresponding to a dot arrangement of the colored printing material on the recording medium; and performing path decomposition processing on the dot arrangement data to arrange a larger number of dots of the colored printing material to be recorded on the projected portion of the unevenness at a center of the projected portion than at edges of the projected portion.

20. A non-transitory computer-readable storage medium storing instructions that, when executed by a computer, cause the computer to perform an image processing method for generating data for setting different colors for a projected portion and a recessed portion of an unevenness on a surface of a recording medium by recording a colored printing material on at least the projected portion of the unevenness, the image processing method comprising:

acquiring dot arrangement data corresponding to a dot arrangement of the colored printing material on the recording medium; and performing path decomposition processing on the dot arrangement data to arrange a larger number of dots of the colored printing material to be recorded on the projected portion of the unevenness at a center of the projected portion than at edges of the projected portion.

* * * * *